US007357359B2

(12) United States Patent
Yerge et al.

(10) Patent No.: US 7,357,359 B2
(45) Date of Patent: Apr. 15, 2008

(54) ELECTRONIC CODE FOLLOWER RELAY

(75) Inventors: Thomas W. Yerge, Iron Mountain, MI (US); Steven P. Lynch, St. Clair Shores, MI (US)

(73) Assignee: Phase2 Concepts, Inc., St. Clair Shores, MI (US)

( * ) Notice: Subject to any disclaimer, the term of this patent is extended or adjusted under 35 U.S.C. 154(b) by 418 days.

(21) Appl. No.: 11/117,451

(22) Filed: Apr. 29, 2005

(65) Prior Publication Data

US 2005/0258313 A1 Nov. 24, 2005

Related U.S. Application Data

(60) Provisional application No. 60/566,424, filed on Apr. 30, 2004.

(51) Int. Cl.
*B61L 21/00* (2006.01)

(52) U.S. Cl. ..... 246/34 B; 246/34 CT; 246/59; 246/62

(58) Field of Classification Search ..... 246/1 C, 246/34 R, 34 A, 34 B, 34 CT, 41, 58, 287, 246/122 R; 324/76.35, 76.54, 76.75; 701/19, 701/20

See application file for complete search history.

(56) References Cited

U.S. PATENT DOCUMENTS

| | | | | |
|---|---|---|---|---|
| 3,696,356 | A * | 10/1972 | Franke et al. | 340/502 |
| 4,150,417 | A * | 4/1979 | Darrow et al. | 361/198 |
| 4,157,580 | A * | 6/1979 | Auer et al. | 361/167 |
| 4,325,101 | A * | 4/1982 | Grundy | 361/195 |
| 4,415,134 | A * | 11/1983 | Wilson | 246/34 CT |
| 6,592,081 | B2 * | 7/2003 | Yerge | 246/34 CT |

* cited by examiner

*Primary Examiner*—Mark T. Le
(74) *Attorney, Agent, or Firm*—Lowe, Hauptman, Ham & Berner, LLP

(57) ABSTRACT

An electronic code following relay for use in a railroad signaling system includes a timing circuit for receiving an input square wave signal coded at a pre-determined code rate, and regenerating the input square wave signal at the pre-determined code rate after a predetermined time delay; and a driving circuit coupled to the timing circuit for receiving the delayed square wave signal therefrom and conducting, at the predetermined code rate, at least a power source to at least one of various components in the railroad signaling system including a rail of a track. The electronic code following relay is preferably microprocessor-based and uses an opto-coupler and various solid-state relays for conducting various DC and AC power sources to the components of the railroad signaling system.

20 Claims, 11 Drawing Sheets

ELECTRONIC CODE FOLLOWER RELAY

RELATED APPLICATIONS

This application claims the benefit of U.S. Provisional Application No. 60/566,424, filed Apr. 30, 2004, which is incorporated by reference herein in its entirety.

BACKGROUND

The disclosed preferred embodiments in accordance with the present invention relate to an electronic code following relay that acts as a direct, or near direct, replacement for electro-mechanical relays used in railroad signaling systems.

Typically, these electro-mechanical relays are operated from either low nominal pulsed DC voltages of 1.7, or, by nominal pulsed DC voltages of 12. In railroad signaling applications, a code following relay is also known as being a code follower relay, or, a code responsive relay.

Railroad signaling systems have long incorporated in cab code signaled territories to transmit data to trains traveling along the tracks. This data is usually in the form of electrical pulses that are placed onto the rails. These pulses are then detected by the onboard electronic equipment located inside of the train's control cab, or locomotive, to display a cab signal to the train's engineer which assists in the safe movement of said train. A cab signal conveys to a train's driver, or engineer, advance information for the track conditions ahead of the train.

These coded pulses, typically may be, but not limited to, 100 Hz AC currents, or a combination of both 100 Hz and 250 Hz AC currents that are coded at, but not limited to, rates of 50, 75, 120, 180, 270, or 420 beats per minute which corresponds respectively to the frequencies of 0.833 Hz, 1.25 Hz, 2 Hz, 3 Hz, 4.5 Hz, and 7 Hz. Each code rate, with the exception of the 50 code rate, displays its own unique cab signal.

Typically, a Code Transmitter, or other railroad signaling system device, is responsible for the generation of the aforementioned code rates. The coded DC output currents of the Code Transmitter, or other railroad signaling system device, then drives the coil of electro-mechanical code following relays. The internal contacts of the electro-mechanical code following relay then makes/breaks 50 Hz, 60 Hz, 100 Hz, or 250 Hz AC currents, or a combination of any two (2) unlike frequency AC currents, to be placed onto the rails for the train's onboard cab signal system, and/or, other components of a railway signaling system to detect. Additionally, DC currents are also converted into a coded format for use by other components in a railroad signaling system.

If the coding currents are delivered out of specification onto the rails, said currents will be rejected by the train's onboard cab signal system, and, other components of a cab code railroad signaling system. This will result in the most restrictive cab signal to be displayed, and will cause unnecessary train delays. The same problems will arise if the coded currents are delivered onto the rails with inaccurate duty cycles. Duty cycle is understood to be the relationship of time, expressed in percentages, during a pulse, where 1/Freq.=Time (in seconds). An illustration is depicted in FIG. 7.

As shown in FIG. 7, each input code pulse has a duration of T which consists of an on-time period t1, and, an off-time period t2. One time cycle for any given frequency consists of an on-time period (t1), and, an off-time period (t2). The ratio of the on period t1 and the duration of T in percentage is the on-time, or, positive duty cycle portion of the pulse.

The ratio of the off period t2 and the duration of T in percentage is the off-time duty cycle portion of the pulse. Ideally, t1 and t2 will be of equal durations forming what is commonly referred to as a 50/50 duty cycle. T is then understood to be equal to (t1+t2). Though other waveforms are available, the square waveform input pulse as presented in FIG. 7 is recommended for most cab code type railroad signaling systems. FIG. 6 illustrates the relationship of the coded AC currents of a dual frequency cab code signaling system that utilizes 100 Hz and 250 Hz frequencies. It should be noted that in a dual frequency AC signaling system, there are instances when the signaling system will utilize only one of two (2) AC frequencies to correspond to particular signal aspects. The 100 Hz and 250 Hz AC frequency currents should not be construed in a limiting sense, as one with skill in the art can readily contemplate that other AC frequencies could be used as well.

To meet the strict requirements relating to the correctness of the code rate and duty cycle, an appropriate code following relay is needed. Presently, railroads that operate with a cab code signaling system rely on expensive electro-mechanical code following relays to deliver the coded AC currents onto the rails. It has been observed that electro-mechanical code following relays can suffer with inaccurate output, and, have a high incidence of failure as well.

In electro-mechanical code following relays, steady AC currents are applied to a set of contacts. As the coil of said code following relay is coded, the internal contacts then code the applied AC steady current, or currents, at the same code rate that is applied to the relay's coil. However, when the relay contacts internally make and then break at the pre-determined code rate, electrical arcing can occur. This arcing action will, in time, cause the contact surfaces to become high resistive.

Highly resistive contacts will cause a failure in proper code rates being transmitted to the rails. Improper code rates, or, code rates applied at an insufficient power level, will cause unnecessary train delays.

A further important aspect for the coded currents is the duty cycle. Many electro-mechanical code following relays have been observed to produce inaccurate duty cycles. It has been observed that up to 15 milliseconds (0.015 seconds), or longer, can transpire before the opposing contacts are engaged once energy has been applied, or removed, to/from the electro-mechanical relay's coil.

This time delay is the result of the time that is required for the magnetic flux field of the relay's coil to reach a sufficient level to attract the armature, and, the time that transpires during the mechanical motion of the armature. The aforementioned conditions, and other factors, directly affect the on-time percentage (t1) of the code rate's duty cycle.

The off-time percentage of the code rate's duty cycle (t2) is usually dependent upon a spring that is connected to the electro-mechanical code following relay's armature to return the armature back to its original at rest state when controlling currents are removed from the relay's coil. Other factors that can influence the accuracy of the electro-mechanical code following relay include: return spring tension, spacing of the internal contacts, and, other mechanical factors.

Solid-state code following relays are therefore desirable to replace the existing electro-mechanical code following relays. Such solid-state code following relays can provide for coded DC output currents to satisfy other requirements in a railroad signaling system. Typically, in a high speed railroad signaling system, such as the GRS/Alstom AC voltage Phase Selective style, a code following relay can also output coded DC currents for the charging of resistor/capacitor networks, then, said electronic code following relay can also conduct the stored electrical potential from the resistor/capacitor networks to the coils of other DC controlled electro-mechanical relays in a railroad signaling system.

Other applications for a solid state code following relay would be to provide a DC power source to other DC controlled railroad signaling system relays, and, not be limited to the charging of resistor/capacitor networks. However, when a solid-state code following relay is used in conjunction with the charging of resistor/capacitor networks, to conduct the stored electrical potentials from the resistor/capacitor network(s) to the coils of other DC controlled electro-mechanical relay(s) in a railroad signaling system, the design can incorporate the use of solid-state relays having a low on-state voltage drop to ensure the resistor/capacitor networks receive the fullest charge potential from a DC power source.

Furthermore, the use of low on-state voltage drop solid-state relays in a railroad signaling system will also ensure the fullest potential electrical charge stored in resistor/capacitor networks will be transferred from the resistor/capacitor networks to the coil, or coils, of electro-mechanical relay(s) used in a railroad signaling system with minimal losses.

A solution for eliminating the problems associated with electro-mechanical code following relays is therefore to replace them with an electronic version that will function in the same capacity as either a direct, or near direct, replacement device. An electronic replacement version for the electro-mechanical code following relay is desired to also exhibit the same break before make (Form C) Single Pole-Double Throw (SPDT) type operations for one or more sets of contacts.

Furthermore, an electronic version of the electro-mechanical code following relay is desirably made compatible with a railroad's present signaling system, as well as to meet the future needs for a cab code system that will employ the coding of two (2), or more, unlike frequency AC currents.

Furthermore, an electronic code following relay is desirable to also satisfy the need for a window, or time break, to be present between the transmission of two (2) unlike frequency AC currents as prescribed by the specifications of a dual frequency type cab code railroad signaling system.

SUMMARY OF THE INVENTION

An object of the preferred embodiments in accordance with the invention is, therefore, to provide an effective and accurate electronic code following relay for use in railroad signaling systems.

The above and other objects are achieved by an electronic code following relay, comprising a timing circuit for receiving an input square wave signal coded at a pre-determined code rate, and regenerating the input square wave signal at said pre-determined code rate after a predetermined time delay; and a driving circuit coupled to said timing circuit for receiving the delayed square wave signal therefrom and conducting, at the predetermined code rate, at least a power source to at least one of various components in a railroad signaling system and a rail or rails of a track.

In an aspect, the electronic code following relay of the present invention, further comprising a dedicated power source, coupled to at least said timing circuit for providing an isolated DC power source to the timing circuit.

In another aspect, said timing circuit is a microprocessor circuit.

In a further aspect, said driving circuit comprises an opto-coupler coupled to and driven by said microprocessor circuit; and a plurality of solid-state relays coupled to and driven by said opto-coupler for conducting, at the predetermined code rate, various power sources to the various components in the railroad signaling system.

The above and other objects are also achieved by an electronic code following relay for conducting at least one of coded DC and AC currents to various components in a railroad signaling system, the electronic code following relay comprising a controlling relay having an input connectable to a coding power source of the railroad signaling system to receive therefrom a square wave signal coded at a predetermined code rate and duty cycle; a microprocessor integrated circuit coupled to an output of said controlling relay for receiving the square wave signal, said microprocessor integrated circuit comprising at least first and second microprocessor-programmed time delay regulator circuits for delaying the square wave signal with at least first and second different predetermined time delays, respectively; an opto-coupler integrated circuit having at least first and second control inputs coupled to said first and second time delay regulator circuits, respectively, of said microprocessor integrated circuit, and at least first and second independently operated outputs controlled by said first and second time delay regulator circuits via said first and second control inputs, respectively, of said opto-coupler integrated circuit; at least a first solid-state relay coupled to the first output of said opto-coupler integrated circuit, for receiving the square wave signal delayed with the first time delay and conducting, at the predetermined code rate, at least a first power source to certain components in the railroad signaling system; at least a second solid-state relay coupled to the second output of said opto-coupler integrated circuit, for receiving the square wave signal delayed with the second time delay and conducting, at the predetermined code rate, at least a second, different power source to certain components in the railroad signaling system; and a dedicated DC power source coupled to at least said microprocessor integrated circuit for providing an isolated DC power source to the microprocessor integrated circuit.

The above and other objects are further achieved by a combination of an electronic coding power source for generating, at a predetermined code rate, a square wave signal with a predetermined duty cycle; and an electronic code following relay comprising a timing circuit for receiving the square wave signal as an input thereof and delaying the input square wave signal at an output thereof with a predetermined time delay; and a driving circuit coupled to said timing circuit for receiving the delayed square wave signal therefrom and conducting, at the predetermined code rate, at least a power source to various component of a railroad signaling system.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout.

DETAILED DESCRIPTION OF PREFERRED EMBODIMENTS

Figure 1:
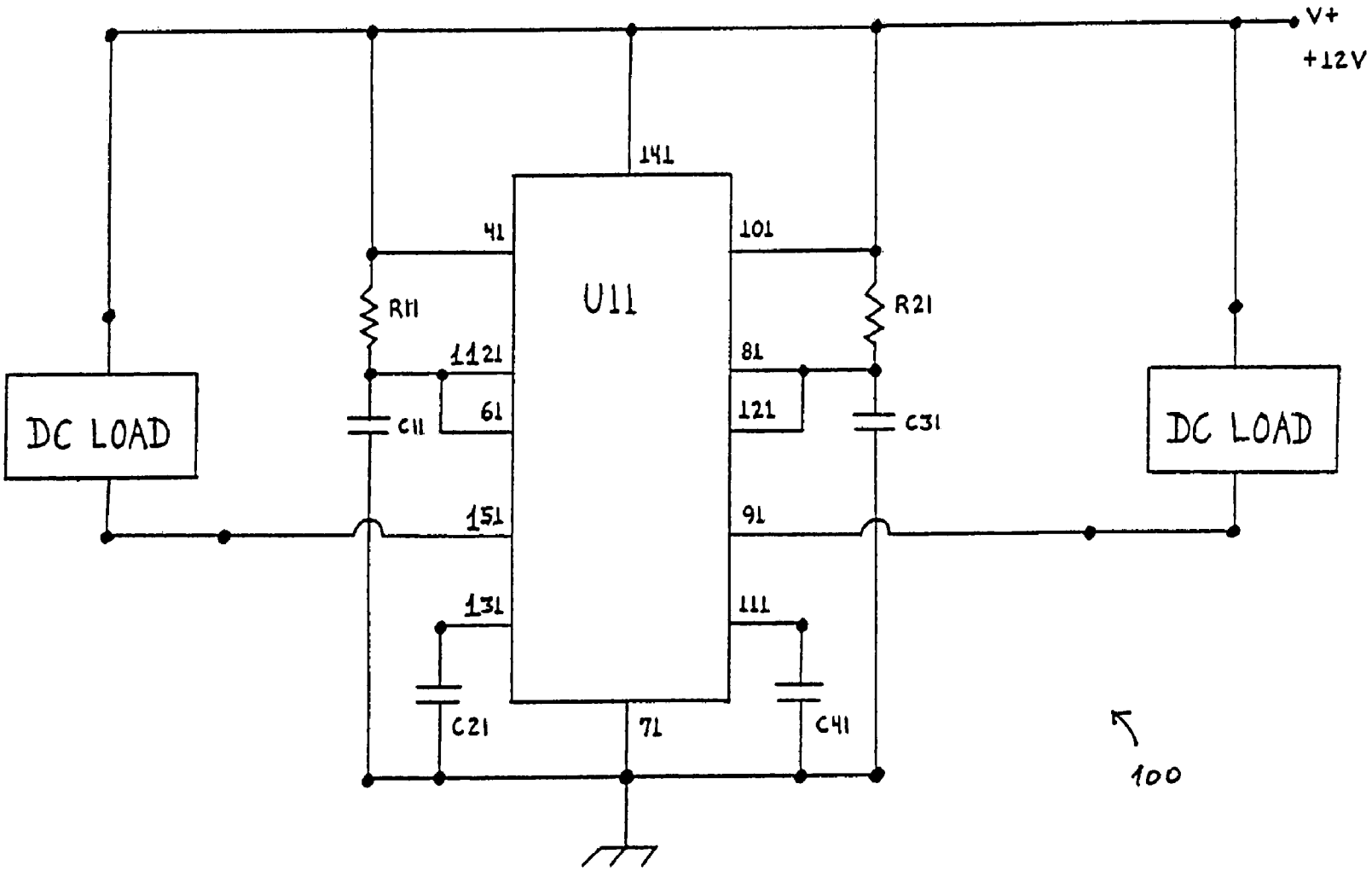
FIG. 1 is a schematic diagram of a basic power up one-shot circuit.

An electronic code follower relay, and a rail road signaling system using the electronic code follower relay in accordance with the present invention are described. In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

Shown in FIG. 1 is a basic power up one-shot circuit 100 which can be used as an electronic code follower relay for non-critical applications. Basic circuit 100 is preferably built with a dual timer IC, which is internally comprised of two individual timer circuits that share a common V+ power source and ground. Each of the internal timer circuits is independently configured with each having its own output. Basic circuit 100 preferably comprises a '556 type dual timer U11, with resistor R11, capacitors C11, and C21 connected to the first internal timer circuit (not shown) of dual timer U11. The second internal timer circuit (not shown) of dual timer U11 is connected to resistor R21, capacitors C31, and C41. As depicted in FIG. 1, the first internal timer pins 41 and 141 of dual timer IC U11 and a first end of the resistor R11 are coupled to a positive direct current voltage V+ of 12 VDC. Pins 1121 and 61 of dual timer IC U11 are coupled to a second end of resistor R11 and a first end of capacitor C11. A second end of capacitor C11 is connected to ground. The capacitor C21 is placed between pin 131 and ground. A pin 71 of dual timer IC U11 is grounded. A pin 151 is an output of dual timer IC U11. In operation, a DC load is connected across the negative output 151 and V+.

As further depicted in FIG. 1, the second internal timer pin 101 and pin 141 of dual timer IC U11 and a first end of the resistor R21 are coupled to a positive direct current voltage V+ of 12 VDC. Pins 81 and 121 of dual timer IC U11 are coupled to a second end of resistor R21 and a first end of capacitor C31. A second end of capacitor C31 is connected to ground. The capacitor C41 is placed between pin 111 and ground. A pin 91 is an output of dual timer IC U11. In operation, a DC load is connected across the negative output 91 and V+.

Basic circuit 100 functions in the power up one-shot mode. The term "one shot mode" refers to the fact that when DC voltage V+ is applied to basic circuit 100, an output will occur only after a pre-determined time delay period expires, and will continue a steady state output until V+ is removed from the circuit.

Upon receiving the DC voltage V+, dual timer IC U11 begins a charging state to capacitors C11 and C31. When capacitor C11 is charged through the resistor R11, a negative output, or, a path to ground, is made available at pin 151 and will not recycle until the removal of V+. The second internal timer circuit of dual timer IC U11 with capacitor C31 being charged through the resistor R21, a negative output, or, a path to ground, is made available at pin 91 after a pre-determined time delay expires, and will not recycle until the removal of V+. Selecting appropriate values for resistors R11 and R21 and capacitors C11 and C31 may set various time delays.

Basic circuit 100 is preferably recommended only for non-critical applications, due to the time delays being affected by any variances with the supply voltage. It is considered not completely stable due to changes in the ambient temperature affecting the values of R11, R21, C11, and C31. Thus, basic circuit 100 is preferably not to be used in railroad signaling systems where the code following relays are exposed to severe environmental conditions, and where the supply voltage also varies.

This and other problems can be solved by electronic code follower relays in accordance with the preferred embodiments of the present invention which are disclosed in above-mentioned U.S. Provisional Application No. 60/566,424 as well as herein below. In particular, the preferred embodiments described herein below provide a microprocessor IC based electronic code follower which is reliable and dependable over a wide range of ambient temperatures, humidity, and supply voltage.

Figure 2A:
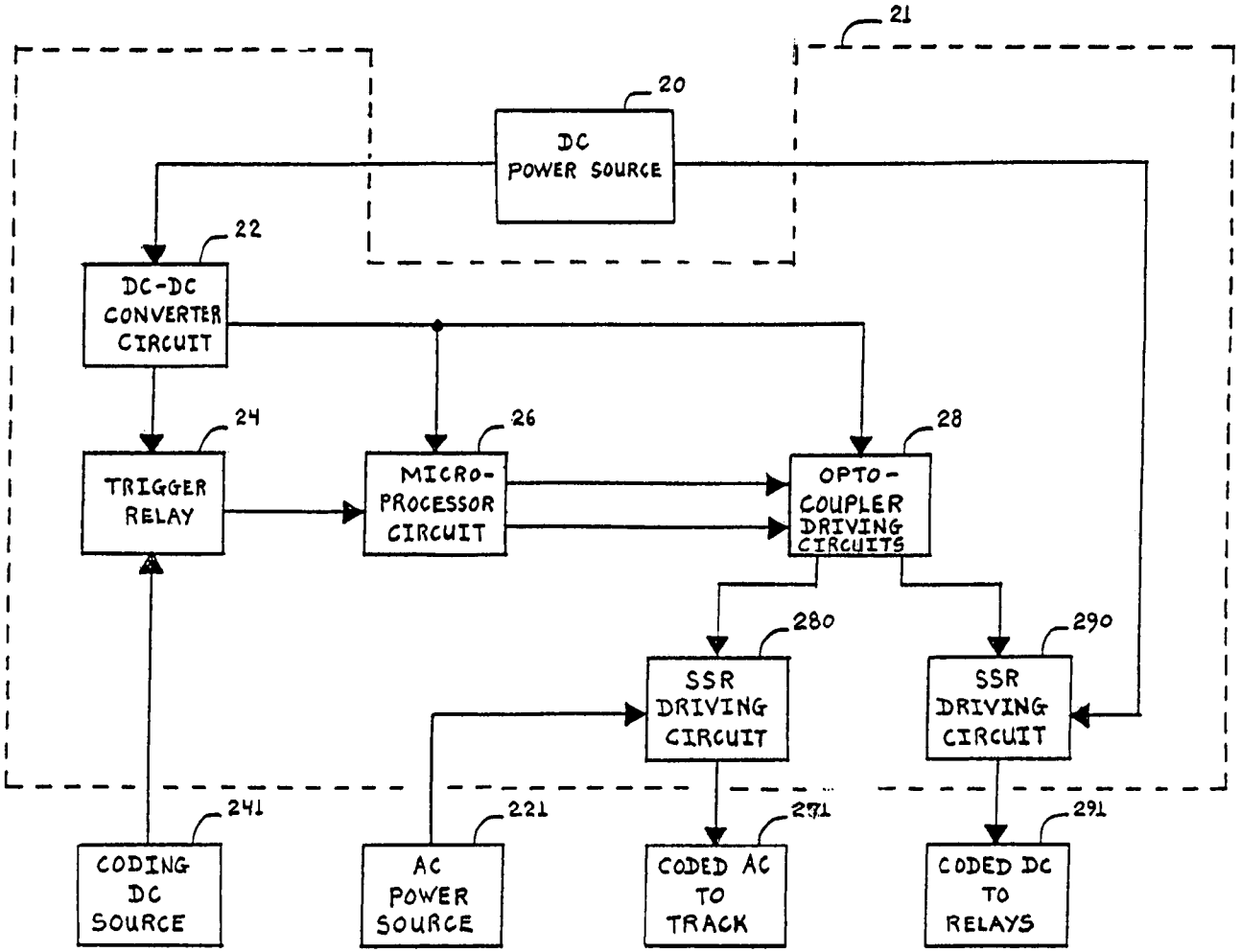
FIG. 2A is a functional block diagram of the electronic code following relay in accordance with preferred embodiments of the invention.

FIG. 2A shows a functional block diagram of an electronic code following relay 21 in accordance with several embodiments of the present invention. Electronic code following relay 21 comprises a dedicated power source 22, a trigger relay 24, a microprocessor circuit 26, an opto-coupler driving circuit 28, and driving circuits 280 and 290. Preferably, opto-coupler driving circuit 28 has one or more Darlington outputs and driving circuits 280 and 290 include solid-state relays. Other arrangements are, however, not excluded.

The dedicated power source 22 receives currents, for example DC currents, from power source 20 or another source, and provides an isolated and regulated power source to microprocessor circuit 26 and to trigger relay 24. Power source 20 is, in most cases, an existing power supply of the existing electro-mechanical code following relays. Dedicated power source 22 is preferably a DC-DC converter circuit of the type disclosed in U.S. Pat. No. 6,592,081 which is incorporated by reference herein in its entirety. Trigger relay 24 delivers coded DC currents to microprocessor circuit 26 when square wave coded DC currents of certain code rates, e.g., 50, 75, 120, 180, 270, 420 pulses per minute, or any code rate utilized by a railroad signaling system's coding DC power source 241 are coupled to the control pins of trigger relay 24. Coding DC power source 241 is preferably an electronic code transmitter of the type disclosed in above-mentioned U.S. Pat. No. 6,592,081. After a pre-determined time delay, microprocessor circuit 26 will trigger opto-coupler driving circuit 28 to output the same square wave coded DC currents that are coupled to the controls of trigger relay 24, with a slightly altered duty cycle due to any required time delay(s) of a railroad signaling system.

The use of trigger relay 24 is an unique aspect of preferred embodiments in accordance with the present invention. As can be seen in FIG. 2A, trigger relay 24 is coupled to coding DC power source 241 of a railroad signaling system for receiving therefrom square wave signals, steady signals, or no signals. The signals received from the railroad signaling system are prone to electrical noise, transients, and varying voltages. It is undesirable to couple such input signals directly to microprocessor circuit 26. In accordance with the preferred embodiment of the present invention, an input voltage from dedicated power source 22 is coupled to trigger relay 24 to output an isolated DC power source from dedicated power source 22 for the triggering of microprocessor circuit 26. In essence, trigger relay 24 replicates the received square wave or steady signals from coding DC power source 241 of the railroad signaling system, but outputs these received signals as an isolated and dedicated square wave or steady signals to be coupled to microprocessor circuit 26. Therefore, not only does dedicated power source 22 act as a source of power for microprocessor circuit 26, dedicated power source 22 is also coded into square wave signals by trigger relay 24 whose output is then coupled to control microprocessor circuit 26, as depicted in FIG. 2A.

The time delayed square wave DC output currents from microprocessor 26 are coupled to controlling pins of opto-coupler driving circuit 28, which preferably operates in an inverse mode, at the code rate dictated by microprocessor circuit 26. Opto-coupler driving circuit 28, which is preferably comprised of four (4) internal independent opto-coupler switches having Darlington outputs, then conducts DC currents from dedicated power source 22 to SSR (solid-state relay) driving circuits 280 and 290. SSR driving circuit 280 then conducts power source 221, which is, e.g., an AC power source, in a coded format to components in a railroad signaling system that conducts AC currents to the rails of track 271 at the code rate dictated by the opto-coupler driving circuit 28.

The SSR driving circuit 290 conducts DC currents from DC power source 20 in a coded format to components in a railroad signaling system that conducts coded DC currents to DC relays 291 at the code rate dictated by opto-coupler driving circuit 28. Although it is depicted in FIG. 2A dedicated power source 22 and driving circuit 290 are connected to the same DC power source 20, other arrangements can be contemplated by one of skill in the art.

Figure 2B:
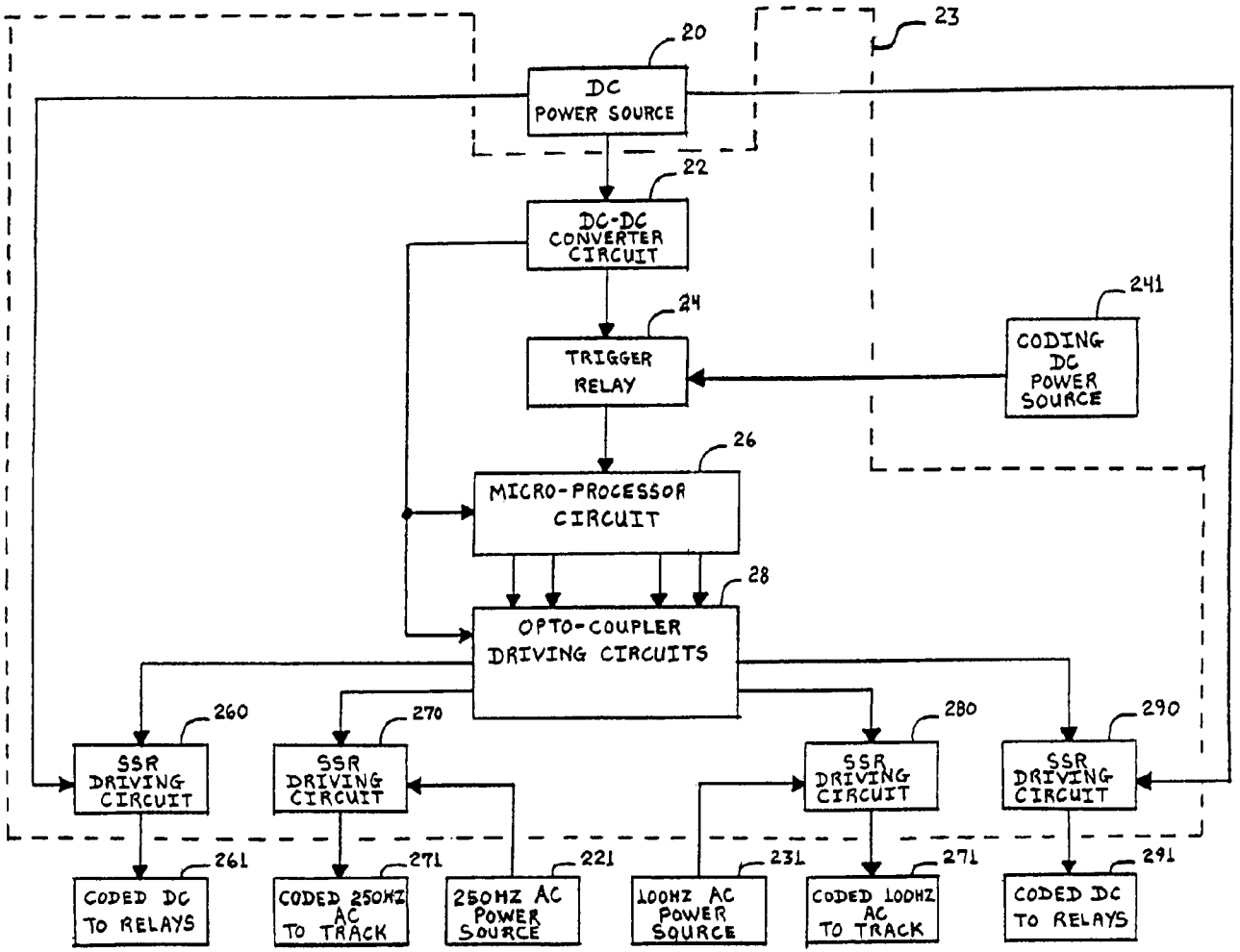
FIG. 2B is an alternative functional block diagram of the electronic code following relay shown in FIG. 2A.

FIG. 2B shows a functional block diagram of an electronic code following relay 23 in accordance with further embodiments of the present invention. Similar to electronic code following relay 21, electronic code following relay 23 comprises a dedicated power source 22, a trigger relay 24, a microprocessor circuit 26, a Darlington output opto-coupler driving circuit 28, and solid-state relay (SSR) driving circuits 280 and 290.

Unlike electronic code following relay 21, which is a single frequency electronic code follower relay, electronic code following relay 23 is a multiple frequency electronic code follower relay and therefore additionally includes driving circuits 260 and 270 which are preferably SSR driving circuits. SSR driving circuits 270 and 280 operate on different frequencies, specifically 250 and 100 Hz, respectively. SSR driving circuits 270 and 280 and/or other driving circuits may be arranged to operate on other frequencies without departing from the scope of the present invention.

Dedicated power source 22, DC power source 20, and trigger relay 24 operate in a manner similar to the embodiment of FIG. 2A. In particular, trigger relay 24 delivers coded isolated DC currents to microprocessor circuit 26 when square wave coded DC currents of 50, 75, 120, 180, 270, 420 pulses per minute, or any code rate utilized by a railroad signaling system's coding DC power source 241 are coupled to the control pins of trigger relay 24. After a pre-determined time delay, microprocessor circuit 26 will output the same square wave coded DC currents that are coupled to the controls of trigger relay 24, but with a slightly altered duty cycle due to any required time delay(s) of the railroad signaling system.

Figure 7:
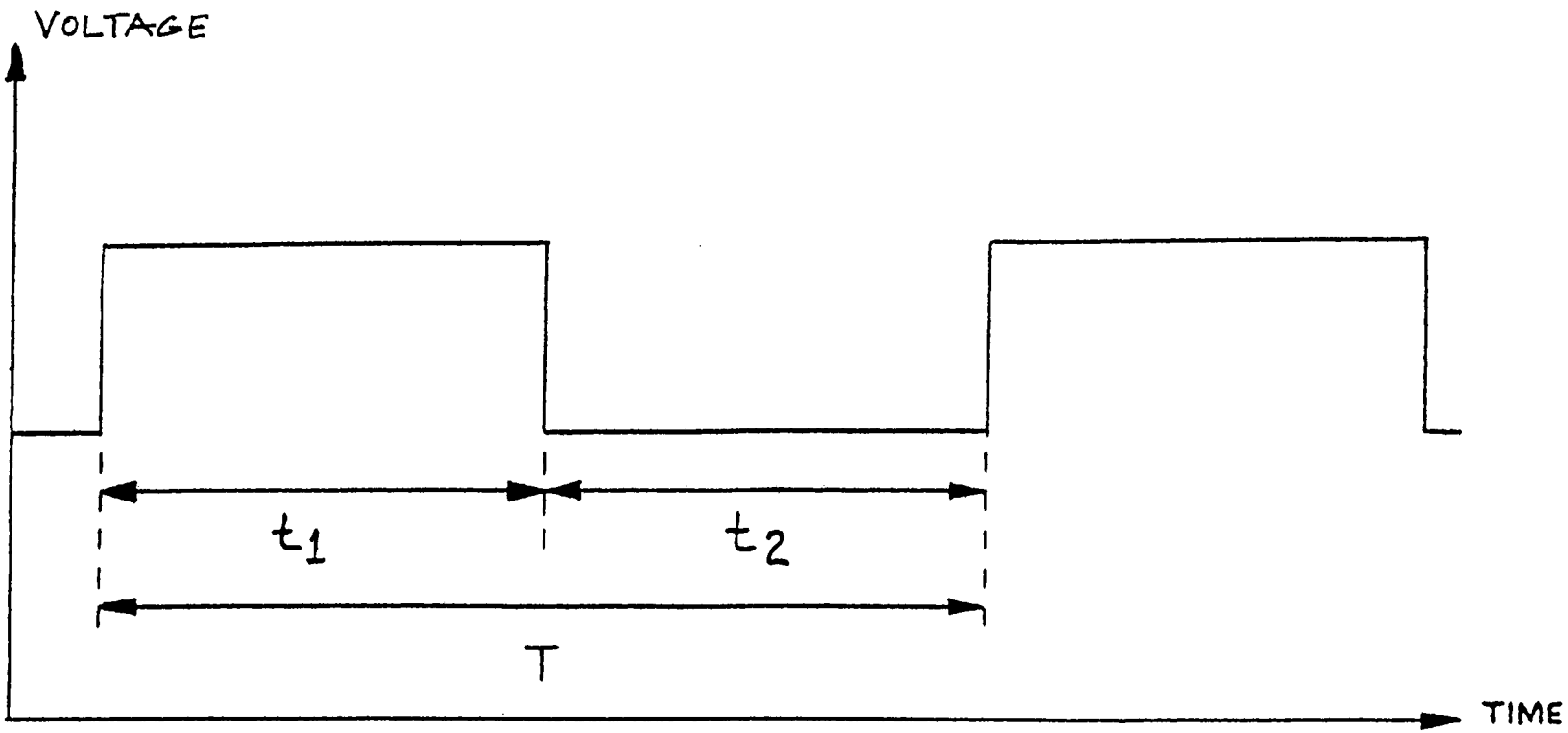
FIG. 7 is a timing chart explaining the term "duty cycle".

The time delayed square wave output currents from microprocessor 26 are coupled to the controlling pins of the Darlington output opto-coupler driving circuit 28, which, however, operates in a relay-like mode, at the code rate dictated by microprocessor circuit 26. The Darlington output opto-coupler driving circuit 28 is preferably comprised of four (4) internal independent opto-coupler switches, and conducts DC currents from dedicated power source DC-DC converter circuit 22 to SSR driving circuits 280 and 290 when microprocessor circuit 26 is triggered by the on-time period (t1, FIG. 7) of the received coded isolated DC currents from trigger relay 24.

SSR driving circuit 280 then conducts currents from a first frequency power source, e.g., 100 Hz AC power source 231, in a coded format to components in a railroad signaling system that couples the coded 100 Hz AC current to the rails of track 271 at the code rate dictated by an output from opto-coupler driving circuit 28. SSR driving circuit 290 conducts DC currents from DC power source 20 in a coded format to components in a railroad signaling system that couples the coded DC currents to DC Relays 291 at the code rate dictated by an output from opto-coupler driving circuit 28. Essentially, SSR driving circuits 280 and 290 form the electronic Normally Open (N.O.) contacts of electronic code following relay 23.

During the off-time period (t2, FIG. 7) from coding DC power source 241, trigger relay 24 is in an open state, microprocessor circuit 26 then turns on two (2) output drive voltages to opto-coupler driving circuit 28 operating in an inverse mode to turn off SSR driving circuits 280 and 290. After the predetermined time delays as dictated by the internal programming of microprocessor circuit 26 have expired, microprocessor circuit 26 then shuts off driving voltages to two (2) controlling pins of opto-coupler driving circuit 28 which then conducts driving voltages to SSR driving circuits 270 and 260.

SSR driving circuit 270 then conducts a second frequency power source, e.g., 250 Hz AC power source 221, in a coded format to components in a railroad signaling system that couples 250 Hz AC currents to the rails of track 271 at the code rate dictated by an output from opto-coupler driving circuit 28.

The SSR driving circuit 260 conducts DC currents from DC power source 20 in a coded format to components in a railroad signaling system that couples the coded DC current to the DC relays 261 at the code rate dictated by an output from opto-coupler circuit 28. Essentially, SSR driving circuits 270 and 260 form the electronic Normally Closed (N.C.) contacts of electronic code following relay 23. Although it is depicted in FIG. 2A that the dedicated power source 22 and the SSR driving circuit 260 and SSR driving circuit 290 are connected to the same DC power source 20, other arrangements can be contemplated by one of skill in the art.

For railroad signaling systems that require only one (1) AC power source, one of skill in the art can contemplate that either SSR driving circuit 270 or 280 may be used to couple the respective AC power source 221 and 231 to the rails of track 271.

The programmed time delayed outputs from microprocessor circuit 26 preferably include the maximum turn off time characteristics present in solid-state relays, including the additional ½ cycle of AC currents that conducts after controlling voltages have been removed. The time-delayed outputs should also include any required time delay windows required by a railroad signaling system.

Figure 5A:
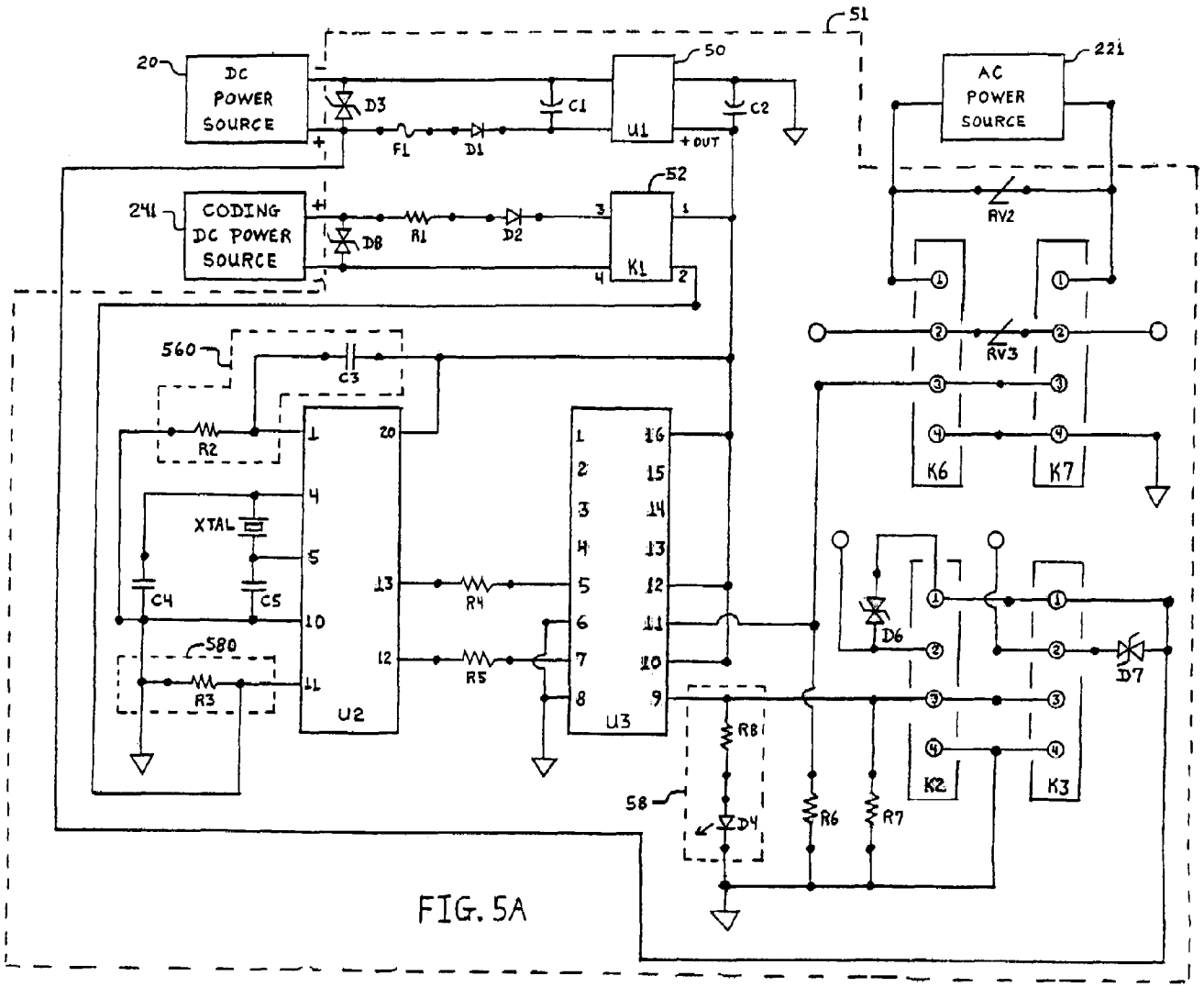
FIG. 5A is an alternative circuit diagram of the electronic code following relay shown in FIG. 2A.

The electronic code following relay 21 shown in FIG. 2A can be implemented by a microprocessor IC based circuit 51, which is illustrated in FIG. 5A. The microprocessor IC based circuit 51, among other things, comprises a DC-DC converter circuit 50 (which is equivalent to dedicated power source 22), a relay K1 or 52 (which is equivalent to trigger relay 24), microprocessor IC U2 (which is equivalent to microprocessor circuit 26), time delay reset regulator circuit 560 comprised of resistor R2 and capacitor C3, voltage pull down circuit 580 comprised of resistor R3 for the proper triggering of microprocessor IC U2, opto-coupler IC U3 (which is equivalent to opto-coupler driving circuit 28), solid-state relays K2, K3 and K6, K7 (which are equivalent to SSR driving circuits 290 and 280, respectively), and an indicator circuit 58. An output from a pin 12 of IC U2 is coupled to a $1^{st}$ end of voltage drop resistor R5 which also has a $2^{nd}$ end coupled to a control pin 7 of opto-coupler IC U3. An output from a pin 13 of IC U2 is coupled to the $1^{st}$ end of voltage drop resistor R4 which also has a $2^{nd}$ end coupled to a pin 5 of opto-coupler IC U3. Controls (pins 3) of solid state relays K2 and K3 are coupled to output pin 9 of opto-coupler IC U3, whereas controls (pins 3) of solid state relays K6 and K7 are coupled to output pin 11 of opto-coupler IC U3. Also depicted in FIG. 5A are DC power source 20, coding DC power source 241, and AC power source 221 which may or may not be part of circuit 51.

In FIG. 5A, the converter circuit 50 includes DC-DC converter U1 with capacitors C1 and C2 placed across its input and output, respectively. Preferably, the DC-DC converter U1 is an isolated wide input device, which is capable of powering IC U2 with a stable, regulated, and isolated DC voltage as well as triggering currents via relay K1. Preferably, converter circuit 50 is of the type disclosed in above mentioned U.S. Pat. No. 6,592,081 and relay K1 is of the solid-state type having a low on-state voltage drop. As discussed above with respect to FIG. 2A, solid-state relay K1 functions as trigger relay 24 which isolates microprocessor IC U2 (microprocessor circuit 26) from electrical noise, transients, and varying voltages that accompany square wave signals received from coding DC power source 241 of a railroad signaling system. In essence, solid-state trigger relay K1 replicates the received square wave or steady signals from the railroad signaling system, but outputs these received signals as an isolated and dedicated square wave or steady signals to be coupled to microprocessor IC U2. In this particular configuration, dedicated power source U1 acts as a source of power for microprocessor IC U2 and is also coded into square wave signals by solid-state trigger relay K1 whose output (pin 2 in FIG. 5A) is then coupled to the control (pin 11) of microprocessor IC U2.

It has been found by the inventors that the microprocessor circuit 51 based on micro-controller IC U2 can operate properly even if it is connected directly to the same DC power source 20 in FIG. 2A that supplies U1. In other words, converter circuit 50 may be omitted from circuit 51. However, it is preferred that microprocessor IC U2 receives a power input from an isolated source that is free from electrical noise and transients. The problem can be solved by providing microprocessor IC U2's circuit with a separate power source, and, trigger source, with both being derived from the same or different dedicated power source(s) such as 22 in FIG. 2A or 50 in FIG. 5A. It is further preferable that microprocessor IC U2 receives input power currents, and, trigger currents, from sources other than and independent from power source 20.

The use of DC-DC converter U1 is preferable since this will allow the electronic code following relay of the invention to be a direct replacement for about 67% of the existing electro-mechanical code following relays, without the need to install a supplementary power supply.

In the remaining about 33% of the existing electro-mechanical code following relay applications, such as those that are required only for the coding of AC currents, only a single wire is required to connect to a relay's socket base to couple a V+ from DC power source 20 to the internal electronic circuitry, e.g., 51, of an electronic code follower relay in accordance with the preferred embodiments of the invention.

The DC-DC converter U1's parameters, therefore, will be determined by the power requirements of the electronic code follower relay in accordance with the invention. Likewise, capacitors C1 and C2 are correspondingly chosen so as to meet the minimum manufacturer's filtering requirements, and, to ensure the full parametric performance over the full line and load range of the DC-DC converter U1.

In one embodiment, the converter circuit 50 is connected to DC power source 20 through a serial connection of fuse F1 and diode D1. Fuse F1 operates as a level of surge protection for the whole circuit, and should have a sufficient DC current rating to allow for the high in-rush current that DC-DC converter U1 is subjected to upon start up. Preferably, fuse F1 is an automatic resetting type, with a first end connected to a positive terminal of the DC power source 20, and a second end connected to an anode of diode D1.

The cathode of diode D1 is connected to an electrode of the capacitor C1 of which is coupled to a positive input of DC-DC converter U1. The inclusion of diode D1 is to provide a reversed polarity protection device for DC-DC converter U1.

Preferably, D1 is of a silicon type diode. A diode D3 is coupled across the output of DC power source 20 to provide a level of circuit protection for the whole circuit by limiting the amount of unintended transient and surge currents applied to DC-DC converter U1. Preferably, diode D3 is a transient voltage surge suppressor type having a sufficient voltage clamping level.

In the embodiment of FIG. 5A, trigger relay circuit 24 (of FIG. 2A) is relay K1 which is preferably a solid-state relay having a low on-state voltage drop. In FIG. 5A, trigger relay K1 is connected to coding DC power source 241, e.g., an electronic code transmitter of the type disclosed in above mentioned U.S. Pat. No. 6,592,081, through a serial connection of diode D2 and resistor R1, and a parallel connection of diode D8 across the output of coding DC power source 241. The cathode of diode D2 is connected to positive control pin 3 of relay K1. Preferably, diode D2 is of an ultra fast type. The anode of diode D2 is coupled to a first end of voltage drop resistor R1. The inclusion of diode D2 is to provide a reversed polarity protection device. Preferably, resistor R1 is of the metal film type having a temperature co-efficient (TC) rating of +/−100 ppm, or less. A second end of voltage drop resistor R1 is coupled to the positive output from coding DC power source 241. Resistor R1 limits the amount of voltage applied to the controls of relay K1 to operate relay K1 within its normal voltage range.

The negative side of coding DC power source 241 is coupled to negative control pin 4 of trigger relay K1. Diode D8 is coupled in parallel with the output of coding DC power source 241 to provide a level of circuit protection for the controls of solid-state relay K1.

Preferably, diode D8 is of the transient voltage surge suppressor type with a voltage clamping level not to exceed the maximum allowable voltage range for the control pins of relay K1.

The reset regulator circuit 560 comprises a serial connection of resistor R2 and capacitor C3. The other electrode of capacitor C3 is connected to a positive output of DC-DC converter U1. A second end of charging resistor R2 is connected to a negative output of DC-DC converter U1. A pin 1 of microprocessor U2 is coupled at the serial connection junction of resistor R2 and capacitor C3.

The reset regulator circuit 560 initializes microprocessor IC U2. Microprocessor IC U2 then proceeds to its start up sequence ensuring that none of the circuit 51's solid-state relay drivers (i.e., K2, K3, K6 and K7) conduct output currents. In a preferred configuration, R2 and C3 are chosen to set a reset time at approximately 22,500 machine cycles of microprocessor IC U2 to ensure no ambiguous output currents conduct, especially during times of installing or removing the electronic code following relay 51 to/from a railroad signaling system.

To maintain accurate reset times, it is preferred that capacitor C3 is of a type having a dielectric of metallized Polypropylene and resistor R2 is of a metal film type having a temperature coefficient (TC) rating of at least +/−100 ppm to compensate for changes in the capacitance value of C3 with changes in the ambient operating temperature in a railroad signaling environment.

Voltage pull down resistor circuit arrangement 580 comprises a serial connection of resistor R3 and a pin 11 of microprocessor circuit IC U2. A second end of resistor R3 is connected to the negative output of DC-DC converter U1. Resistor R3 ensures that pin 11 of microprocessor IC U2 is driven to ground potential during the absence of an input voltage from coding DC power source 241.

A first end of quartz crystal XTAL is connected to a pin 4 of microprocessor IC U2. A second end of quartz crystal XTAL is connected to a pin 5 of microprocessor IC U2. The quartz crystal XTAL provides the necessary clock pulses required for the proper operation of the internal program of microprocessor IC U2. Other arrangements that do not require a quartz crystal are not excluded.

A capacitor C4 has a serial connection to a first end of quartz crystal XTAL. The other electrode of capacitor C4 is connected the negative output of DC-DC converter U1. A capacitor C5 has a serial connection to a second end of quartz crystal XTAL. The other electrode of capacitor C5 is connected the negative output of DC-DC converter U1. Capacitors C4 and C5 ensures quartz crystal XTAL enters into a proper state of oscillation.

In one embodiment, the microprocessor IC U2 is of a flash memory type and having characteristics of which are well known in the art, and need not be recited herein. Any device and a combination of devices having similar characteristics can be substituted. As shown in FIG. 5A, pin 20 of microprocessor IC U2 is coupled to the positive output of DC-DC converter U1. Pin 11 of microprocessor IC U2 is coupled to output pin 2 of solid-state relay K1.

When a sequence of coding square wave currents are coupled from the coding DC power source 241 to a positive control pin 3 of solid state relay K1, when the voltage of pin 3 of relay K1 is at a HIGH level during the on-time period (t1, FIG. 7) of the input code's duty cycle from coding DC power source 241, pin 2 of relay K1 conducts currents from the DC-DC converter circuit U1 to a pin 11 of microprocessor circuit IC U2. The voltage of pin 2 of solid-state relay K1 is then at a HIGH level.

When the voltage at pin 3 of solid state relay K1 is at a LOW level during the off-time period (t2, FIG. 7) of the input code's duty cycle from coding DC power source 241, solid-state relay K1 isolates the DC currents from DC-DC converter circuit U1 from pin 11 of microprocessor circuit IC U2.

In an aspect of the present invention, a pin 13 of microprocessor circuit IC U2 is coupled to a first end of load resistor R4. A second end of load resistor R4 is coupled to a pin 5 of opto-coupler circuit IC U3. A pin 12 of microprocessor circuit IC U2 is coupled to a first end of load resistor R5. A second end of load resistor R5 is coupled to a pin 7 of opto-coupler circuit IC U3. The inclusion of load resistors R4 and R5 are correspondingly chosen so as to ensure proper square wave pulses with proper duty cycle and voltage level are coupled to pins 5 and 7 of opto-coupler circuit IC U3.

In another aspect of the present invention solid-state relays K2 and K3 are of a type having direct current (DC) outputs, where a pin 9 of opto-coupler circuit IC U3 is coupled to a positive control pin 3 of solid-state relay K2. A positive control pin 3 of solid-state relay K3 is coupled to the positive control pin 3 of solid-state relay K2. A negative control pin 4 of solid-state relay K2 is coupled to a negative control pin 4 of solid-state relay K3 that is coupled to a negative output of DC-DC converter circuit U1. This arrangement of control pins for solid-state relays K2 and K3 effectively couples the controls of solid-state relays K2 and K3 in parallel. Thus, the output driving voltage from a pin 9 of opto-coupler circuit IC U3 maintains a sufficient level of driving voltage to the controls of solid-state relays K2 and K3. Therefore, a maximum drive voltage is ensured to each solid-state relay.

In still another aspect of the present invention, solid-state relays K6 and K7 are of a type having alternating current (AC) outputs, where a pin 11 of opto-coupler circuit IC U3 is coupled to a positive control pin 3 of solid-state relay K6. A positive control pin 3 of solid-state relay K6 is coupled to a positive control pin 3 of solid-state relay K7. A negative control pin 4 of solid-state relay K6 is coupled to a negative control pin 4 of solid-state relay K7 and is coupled to the negative output of DC-DC converter U1. This arrangement of control pins for solid-state relays K6 and K7 effectively couples the controls of solid-state relays K6 and K7 in parallel. Thus, the output voltage from a pin 11 of opto-coupler circuit IC U3 maintains a sufficient level of driving voltage to the controls of solid-state relays K6 and K7. Therefore, a maximum drive voltage is ensured to each solid-state relay.

The indicator circuit 58 includes resistor R8 and LED D4. LED D4 has a cathode coupled to a negative output from DC-DC converter circuit U1 and an anode coupled to a first end of voltage drop resistor R8. A second end of voltage drop resistor R8 is connected to a pin 9 of opto-coupler circuit IC U3.

Though indicators of any kind, such as incandescent lamps, can be used in the indicator circuit 58, light emitting diodes (LED) are preferable due to their long life span and reduced power consumption. The resistor R8 serves as a voltage drop resistor to allow LED D4 to operate within its normal voltage range. LED D4 provides a visual indication when the electronic Normally Open (N.O.) contacts, i.e., relays K2, K3, K6 and K7, are in a conductive state.

The placement of indicator circuit 58 at the output of opto-coupler circuit IC U3 is preferable so as to prevent indicator circuit 58 from draining any stored potential charges on the resistor/capacitor network(s) that energize other electro-mechanical relays in some railroad signaling systems.

Figure 5B:
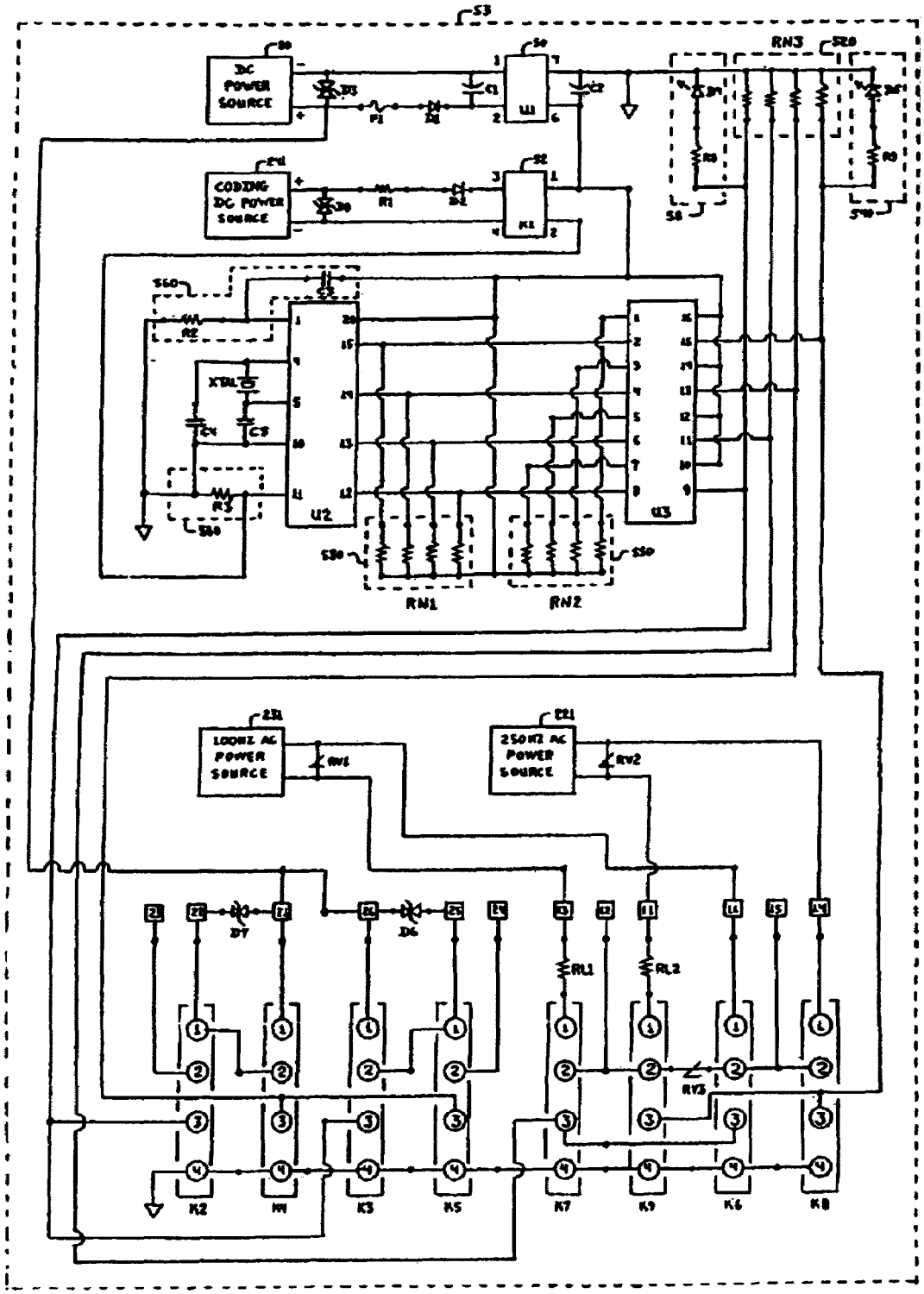
FIG. 5B is an alternative circuit diagram of the electronic code follower relay shown in FIG. 5A.

The electronic code following relay 23 shown in FIG. 2B can be implemented by a microprocessor IC based circuit 53, which is illustrated in FIG. 5B. The circuit in FIG. 5B is similar in many aspects to the circuit in FIG. 5A, with the identical components being designated by the same reference numbers. Therefore, it is not necessary to describe these components again.

The circuit 53 in FIG. 5B differs from circuit 51 in FIG. 5A in that the DC outputs of solid-state relay drivers K2, K3, K4, and K5 are so arranged as to effectively operate in a present GRS/Alstom AC Phase Selective railroad signaling system. The AC outputs of solid-state relay drivers K6, K7, K8, and K9 are so arranged as to provide for Single Pole Double Throw (SPDT) break before make/Form C relay like operations. Other contact arrangements can be contemplated by one of skill in the art so as to allow for solid-state relay drivers K2, K3, K4, and K5 to also provide for Single Pole Double Throw (SPDT) break before make/Form C relay like operations, as well as other contact arrangements.

In FIG. 5B, the connection points to a GRS/Alstom Phase Selective Signaling System are represented by numbered squares indicating the serial connections made to the code following relay 53 in accordance with the invention. Such connections should not be construed in a limiting sense as one with skill in the art can contemplate other circuit connection arrangements.

In an aspect of the present invention, pin 2 of relay K6 has a serial connection to pin 2 of relay K8. Pin 2 of relays K6 and K8 are coupled to a first end of a varistor, e.g., a Metal Oxide Varistor (MOV), RV3 with a second end of RV3 coupled to pin 2 of relays K7 and K9. Effectively, MOV RV3 is coupled in parallel with the AC currents coupled to the rails of track 271.

In yet another aspect of the present invention, pin 1 of solid-state relay K7 is coupled to a first end of In-Rush Current Limiter RL1. A second end of In-Rush Current Limiter RL1 is coupled to a first end of another varistor, e.g., a Metal Oxide Varistor (MOV), RV1 that is coupled to a first end of 100 Hz AC power source 231. A second end of Metal Oxide Varistor (MOV) RV1 is coupled to a second end of 100 Hz AC power source 231 that is coupled to a pin 1 of solid-state relay K6. Effectively, MOV RV1 is coupled in parallel with output currents from 100 Hz AC power source 231 and the AC current inputs of solid-state relays K7 and K6.

In a further aspect of the present invention and as depicted in FIG. 5B, pin 1 of solid-state relay K8 is coupled to a first end of a varistor, e.g., a MOV (Metal Oxide Varistor) RV2 that is coupled to a first output end of 250 HZ AC power source 221. A second end of MOV RV2 is coupled to a second output end of 250 HZ AC power source 221 and a first end of In-Rush Current Limiter RL2. Effectively, MOV RV2 is coupled in parallel with AC currents conducting from 250 HZ AC power source 221 as depicted in FIG. 5B.

Each of MOV RV1, RV2, and RV3 is preferably of the new generation type surge suppressor that utilizes a new ceramic material composition that features a very large energy handling capability up to 6,500 Amperes to effectively protect the circuit from lightning damage and other surges, especially of those associated with electrified type railroads.

In an alternative arrangement, the second end of In-Rush Current Limiter RL1 is coupled in series with the fused terminal of 100 Hz AC power source 231. Similarly, pin 1 of solid-state relay K9 is coupled to a second end of In-Rush Current Limiter RL2, with a first end of In-Rush Current Limiter RL2 coupled to a fused leg of 250 HZ AC power source 221, as depicted in FIG. 5B. Due to the high in-rush currents caused when an inductive load is coupled to solid-state relays having very fast switching capabilities, a current in-rush limiter, such as RL1 or RL2, is coupled in series with pin 1 of solid-state relay K7 or K9 and the fused leg of 100 Hz (or 250 Hz) AC power source 231 (221) to avoid nuisance and un-necessary circuit breaker trips, and/or fuses to burn open.

In yet another aspect of the present invention, pin 1 of relay K2 is coupled to a first anode of bi-directional transient voltage surge (TVS) suppressor diode D7. Pin 1 of relay K4 is coupled to the second anode of TVS diode D7, and is coupled to a positive terminal of DC power source 20. Generally, the TVS diode D7 protects solid-state relays K2 and K4 from electromagnetic frequency noise spikes generated by electro-mechanical relays in a railroad signaling system, and, other transients.

In still another aspect of the present invention, pin 1 of relay K3 is coupled to a first anode of bi-directional transient voltage surge (TVS) suppressor diode D6, and is coupled to a positive terminal of DC power source 20. A pin 1 of relay K5 is coupled to a second anode of TVS diode D6. Generally, the TVS diode D6 protects solid-state relays K3 and K5 from electromagnetic frequency noise spikes generated by electro-mechanical relays in a railroad signaling system, and, other transients.

In accordance with the preferred embodiments of the present invention, solid state relays K2 and K3 conduct positive DC output currents from DC power source 20 during the on-time period (t1, FIG. 7) of the duty cycle for the input currents from coding DC power source 241. Solid-state relays K2 and K3 outputs are then coupled to other components in a railroad signaling system, such as, but not limited to, other electro-mechanical relays, or, for the charging of resistor/capacitor (R/C) networks used in a railroad signaling system, and the conducting of the stored potential charge(s) from the R/C networks to other components used in a railroad signaling system.

In-another aspect of the present invention, solid-state relays K4 and K5 conducts positive DC output currents from DC power source 20 during the off-time period (t2, FIG. 7) of the duty cycle of the coding input currents from coding DC power source 241. Solid-state relays K4 and K5 outputs are then coupled to other components in a railroad signaling system, such as, but not limited to, other electro-mechanical relay(s), or, for the charging of resistor/capacitor (R/C) networks used in a railroad signaling system, and the conducting of the stored potential charge(s) of R/C networks to other components used in a railroad signaling system.

In a preferred embodiment of the present invention, solid state relays K2, K3, K4, and K5 are capable of conducting up to 3 Amperes of direct current (DC) having a maximum voltage of 60, depending on the following factors:

breakdown voltage and current ratings of TVS diodes D6 and D7 voltage of DC power source 20 ambient operating temperatures temperature based de-rating curves for solid-state relays K2, K3, K4, and K5

For example, for solid-state relays K2, K3, K4, and K5, being of identical makes, the output load current ratings decrease with increases in ambient operating temperatures. In a typical railroad signaling application, where solid state relays K2 and K3 conduct coded DC currents, a conducting capability of approximately 280 milli-Amperes (280 mA) would be required with DC power source 20 supplying a nominal 13.5 output voltage.

The outputs of solid-state relays K2, K3, K4, and K5 are de-rated for a maximum of 1.25 Amperes DC at an ambient operating temperature of 80° C. (176° F.). It has been noted for the Northeast Corridor railroad signaling systems, where a cab code type signaling system is extensively used, the maximum ambient operating temperatures seldom exceed 51.6° C. (125° F.), whereas solid state relays K2, K3, K4, and K5 would have a de-rated DC output current of approximately 2.1 Amperes.

In accordance with the preferred embodiment shown in FIG. 2B, driving circuit 280 conducts alternating current (AC) outputs from 100 Hz AC Power Source 231 during the on-time period (t1, FIG. 7) duty cycle of the input currents from coding DC power source 241. In FIG. 5B, solid state relays K6 and K7 constitute driving circuit 280 and conduct AC output currents to other components in a railroad signaling system, such as, but not limited to, other electromechanical relay(s), and/or transformers used in a railroad signaling system to thereby couple the coded AC currents to the rails of track 271 in a cab coded signaling system within a specified level.

In a preferred embodiment of the present invention, solid-state relays K6, K7, K8, and K9 are capable of conducting up to 5 Amperes of alternating current (AC) having a maximum voltage of 280, depending on the following factors:

breakdown voltage and current ratings for MOVs RV1, RV2, and RV3 current rating of in-rush limiters RL1 and RL2 voltage of 100 Hz AC power source 231 voltage of 250 Hz AC power source 221 ambient operating temperatures temperature based de-rating curves for solid-state relays K6, K7, K8, and K9

For example, for solid-state relays K6 and K7, being of identical makes, the output load current ratings decrease with increases in ambient operating temperatures. In a typical railroad signaling application, where solid-state relays K6 and K7 conduct coded AC currents, a conducting capability of approximately 500 milli-Amperes (500 mA) would be required from 100 Hz AC power source 231 supplying a nominal output voltage of 80. The outputs of solid-state relays K6 and K7 are de-rated for a maximum of 2 Amperes AC at an ambient operating temperature of 80° C. (176° F.). It has been noted that the typical ambient operating temperatures for the Northeast Corridor railroad signaling systems, where a single AC frequency and dual AC frequencies cab code type signaling system is extensively used, seldom exceeds 51.6° C. (125° F.), whereas solid state relays K6 and K7 would have a de-rated AC output current of approximately 3.5 Amperes. Solid-relays K8 and K9 conduct coded AC currents from 250 Hz AC power source 221 and have the same or similar operational characteristics as solid-state relays K6 and K7 and need not be recited again.

Figure 3A:
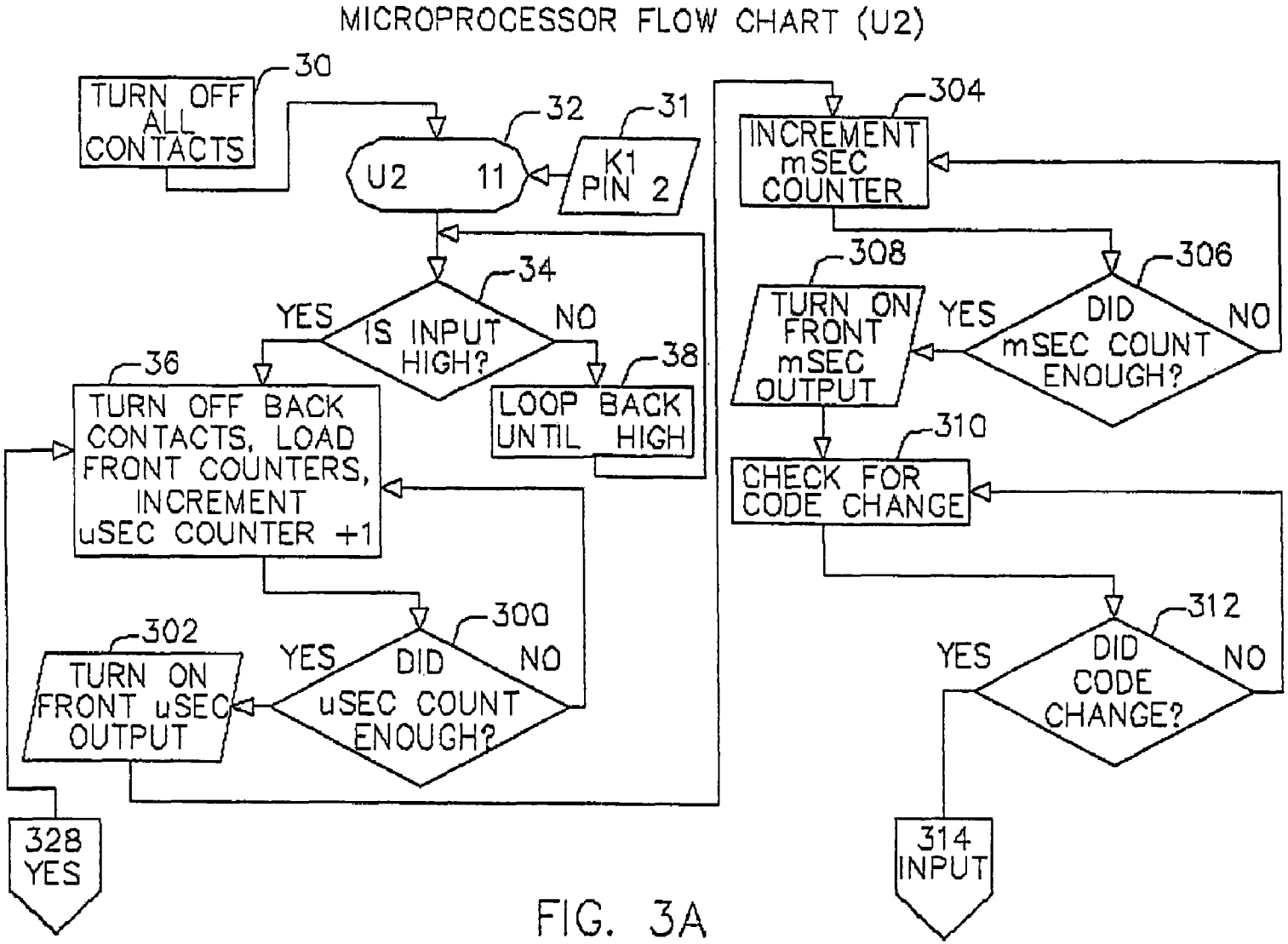
FIGS. 3A and 3B are a functional flow chart diagram of the microprocessor operations of the electronic code following relay shown in FIG. 2B.
Figure 3B:
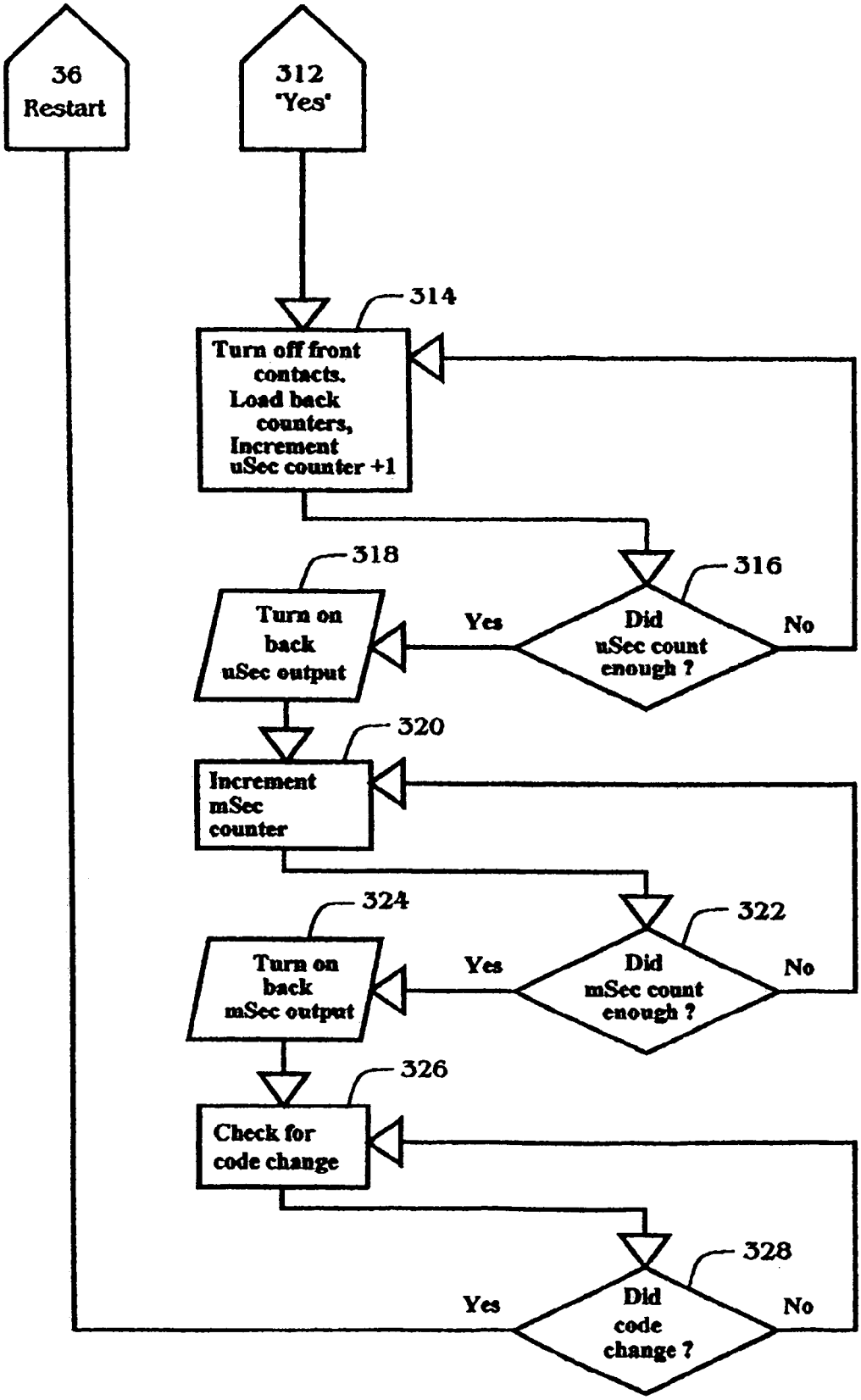

FIGS. 3A and 3B are two parts of a flow chart representation of the internal programming of the microprocessor circuit 26 depicted in FIG. 2B or microprocessor IC U2 of FIG. 5B. In FIG. 3, at the startup 30 of microprocessor U2 all outputs of microprocessor U2 are set HIGH resulting in no drive voltages being coupled to the controls of opto-coupler IC U3 in FIG. 5B due to the implementation of output reversal circuits 530 and 550 which will be described in more detail below. Therefore, during a HIGH output state of microprocessor U2, the controls of opto-coupler IC U3 remain off.

At process 31, a check is made for a positive voltage input from a pin 2 of K1 to a pin 11 of microprocessor U2. Process 34 validates if pin 11 of U2 is in a LOW or HIGH state. If the input from pin 2 of K1 is in a LOW (off) state, the program is looped through process 38 until the pin 11 of microprocessor U2 is placed into a HIGH (on) state.

When pin 11 of microprocessor U2 is placed into a HIGH (on) state, process 36 will command the shut off of the output driving voltages, at pins 13, 15 of opto-coupler IC U3 via pins 14, 15 of microprocessor IC U2, respectively, for the Normally Closed (N.C.) contacts or SSR driving circuits, i.e., K4, K5, K8, K9. At this point, the program is assumed to have run through for at least one (1) cycle, at which the driving circuitry for the Normally Closed (N.C.) contacts or SSR driving circuits, i.e., K4, K5, K8, K9, were turned on during one of the latter processes. A first counter, preferably a μs counter (not shown in FIG. 5B), for a first set of Normally Open (N.O.) contacts or DC voltage SSR driving circuits, i.e., K2 and K3, now begins to load.

Process 300 validates the first, microsecond (μs) counter and performs a check on the count. If the count is found to be insufficient, a loop through to process 36 occurs to continue the count. If the count satisfies the time delay period, the program proceeds to process 302 and turn off output at pin 12 of microprocessor U2 to turn on a first control, i.e., pin 8, of opto-coupler IC U3 to output a drive voltage, at pin 9 of opto-coupler IC U3, to the controls, i.e., pins 3, of the first set of Normally Open (N.O.) contacts or DC voltage SSR driving circuits, i.e., K2 and K3.

The program then proceeds to process 304 to increment a second counter, preferably a millisecond (ms) counter (not shown in FIG. 5B), for a second set of Normally Open (N.O.) contacts or AC voltage SSR driving circuits, i.e., K6 and K7. A check is made, at process 306, to ensure the count was sufficient to produce an output. If the count is found to be insufficient, the program loops through process 304 and increment the second, ms counter again. When the count is found to be sufficient, the program proceeds to process 308 and turn off output at pin 13 of microprocessor U2 to turn on a second control, i.e., pin 6, of opto-coupler IC U3 to output a drive voltage, at pin 11 of opto-coupler IC U3, to the controls, i.e., pins 3, of the second set of Normally Open (N.O.) contacts of AC voltage SSR driving circuits, i.e., K6 and K7.

At process 310 a check is made for code change, i.e., an input voltage status change on pin 11 of microprocessor U2, i.e., pin 2 of K1. At process 312, if the input voltage status did not change, the program returns to process 310. At process 312, if the input voltage status did change, process 314 (FIG. 3B) immediately turns off the drive voltage outputs at pins 9, 11 of opto-coupler IC U3 via pins 12, 13 of microprocessor IC U2, respectively, to remove the latched ON states of opto-coupler IC U3. Process 314 now loads a third counter (not shown in FIG. 5B) for a first set of the Normally Closed (N.C.) contacts or DC voltage SSR driving circuits, i.e., K4 and K5.

Process 316 checks the third counter, which is preferably a microsecond (μs) counter. If the count is found to be insufficient, a loop through process 314 occurs to continue the count. If the count satisfies the time delay period, the program proceeds to process 318 and turn off output at pin 14 of microprocessor U2 to turn on a third control, i.e., pin 4, of opto-coupler IC U3 to output a drive voltage, at pin 13 of opto-coupler IC U3, to the controls, i.e., pins 3, of the first set of Normally Closed (N.C.) contacts or DC voltage SSR driving circuits, i.e., K4 and K5.

The program then proceeds to process 320 to increment a fourth counter, which is preferably a millisecond (mc) counter (not shown in FIG. 5B), for a second set of Normally Closed (N.C.) contacts or AC voltage SSR driving circuits, i.e., K8 and K9. A check is made to ensure the count was sufficient to produce an output at process 322. If the count is found to be insufficient, a loop through process 320 is performed and increments the fourth counter again. When the count is found to be sufficient, the program proceeds to process 324 and turn off output at pin 15 of microprocessor U2 to turn on a fourth control, i.e., pin 2, of opto-coupler IC U3 to output a drive voltage, i.e., at pin 15 of opto-coupler IC U3, to the controls, i.e., pins 3, of the second set of Normally Closed (N.C.) contacts or AC voltage SSR driving circuits, i.e., K8 and K9.

At process 326 and 328, a check is made to see if the input voltage state from pin 2 of K1 has changed. If no, the program flow returns to process 326 until a HIGH state from pin 2 of K1 is detected. If yes, the program returns to process 36 and repeats the program flow.

The operation of the Normally Open (N.O.) contacts, i.e., relays K2, K3, K6 and K7, of the electronic code following relay 53 depicted in FIG. 5B is described below with reference to the timing chart shown in FIG. 4.

When a nominal DC trigger voltage, e.g., of 5, is applied, at a1, a2, or a3, from the positive output of DC-DC converter U1 coupled through solid-state relay K1 to pin 11 of microprocessor IC U2, process 36 in FIG. 3 will command the shut off of the output driving voltages, at pins 13, 15 of opto-coupler IC U3 via pins 14, 15 of microprocessor IC U2, respectively, for solid state relays K4, K5, K8 and K9.

Process 36 in FIG. 3A then begins to increment the first, microsecond (μs) time delay counter. Once the time delay has reached its pre-programmed time delay period at process 300, process 302 commands, at td1, td2, or td3, during the on-time t1 of the duty cycle T, a shut off of output driving voltage from pin 12 of microprocessor U2 coupled to control pin 8 of opto-coupler IC U3 which operates in an inverse state. A delayed positive driving voltage output from pin 9 of opto-coupler IC U3 is coupled to control pin 3 of solid-state relays K2 and K3.

Process 304 in FIG. 3A then begins to increment the second, millisecond (ms) time delay counter. Once the time delay has reached its pre-programmed time delay period at process 306, process 308 then commands, at td-a, td-b, or td-c, during the on-time t1 of the duty cycle T, a shut off of output driving voltage from pin 13 of microprocessor U2 coupled to control pin 6 of opto-coupler IC U3 which operates in an inverse state. A delayed positive driving voltage output from pin 11 of opto-coupler IC U3 is coupled to positive control pin 3 of solid-state relays K6 and K7.

Processes 310 and 312 in FIG. 3A then check for a change in status on pin 11 of microprocessor IC U2. If the voltage status on pin 11 of microprocessor U2 is at or near 0 volts, when a trigger voltage of VDC at or near 0 volts occurs at b1, b2, or b3 in FIG. 4, process 314 (FIG. 3B) immediately conducts output driving voltages from pins 12 and 13 of microprocessor IC U2 to control pin 6 and control pin 8 of opto-coupler IC U3. Essentially, this terminates the output currents from solid-state relays K2, K3, K6, and K7 since the controls of opto-coupler IC U3 operate in an inverse state.

For any new cycles to begin again, a nominal voltage of, preferably, 5 VDC would have to be coupled to pin 11 of microprocessor IC U2 from pin 2 of solid-state relay K1, whereas solid-state relay K1's controls are triggered during the positive duty cycle pulses (t1) from coding DC power source 241 in FIGS. 2B and 5B. Solid-state relays K2, K3, K6, and K7 electronically function as the Commons (C) and the Normally Open (N.O.) contact sets of a Form C type Single Pull Double Throw (SPDT) electro-mechanical relay.

The operation of the Normally Closed (N.C.) contacts of the electronic code following relay 53 depicted in FIG. 5B is described below with reference to the timing chart shown in FIG. 4A.

As discussed above, when a DC trigger voltage VDC at or near 0 volts occurs at b1, b2, or b3, from the positive output of DC-DC converter U1 that is coupled through solid-state relay K1 to pin 11 of microprocessor IC U2, process 314 in FIG. 3B will command the shut off of the output driving voltages, at pins 9, 11 of opto-coupler IC U3 via pins 12, 13 of microprocessor IC U2, respectively, for solid state relays K2, K3, K6 and K7.

Process 314 also loads the third, microsecond (μs) time delay counter for the DC output Normally Closed (N.C.) contacts, or "back contacts", comprised by solid-state relays K4 and K5. Process 316 validates if the proper delay time has transpired. If yes, process 318 commands, at td1A, td2A, or td3A, during the off-time t2, of the duty cycle T, a shut off of output driving voltage from pin 14 of microprocessor U2 coupled to control pin 4 of opto-coupler IC U3 that operates in an inverse state. A delayed positive driving voltage output from pin 13 of opto-coupler IC U3 is coupled to positive control pin 3 of solid-state relays K4 and K5.

Process 320 in FIG. 3B then begins to increment the fourth, millisecond (ms) time delay counter for the AC output Normally Closed (N.C.) contacts, or "back contacts", comprised by solid-state relays K8 and K9. Process 322 validates if the proper delay time has transpired. If yes, process 324 commands, at td-aA, td-bA, or td-cA, during the off-time t2 of the duty cycle T, a shut off of output driving voltage from pin 15 of microprocessor U2 coupled to control pin 2 of opto-coupler IC U3 that operates in an inverse state. A delayed positive driving voltage output from pin 15 of opto-coupler IC U3 is coupled to positive control pin 3 of solid-state relays K8 and K9.

Process 326 in FIG. 3B then checks for a change in status on pin 11 of microprocessor IC U2. At process 328, if the voltage status on pin 11 of microprocessor U2 is at or near 5 volts, when a nominal DC trigger voltage of 5 is applied at a1, a2, or a3 in FIG. 4A, process 36 immediately conducts output driving voltages from pins 14 and 15 of microprocessor IC U2. Essentially, this will terminate the output currents from solid-state relays K4, K5, K8, and K9.

For any new cycles to begin again, VDC would have to be removed from pin 11 of microprocessor IC U2 by solid state relay K1, whereas solid state relay K1's controls are off during the off-time duty cycle pulses (t2) from coded DC power source 241 in FIGS. 2B and 5B. Solid-state relays K4, K5, K8, and K9 electronically function as the Commons (C) and the Normally Closed (N.C.) contact sets of a Form C type Single Pull Double Throw (SPDT) electro-mechanical relay.

In order to maintain a true break before make Form C relay like operation, a defined time break should be maintained before other driving circuits, such as 280 and 290 as depicted in FIG. 2B (K2, K3, K6 and K7 in FIG. 5B), or 260 and 270 as depicted in FIG. 2B (K4, K5, K8 and K9 in FIG. 5B) conduct DC currents from DC power source 20 and currents from 100 Hz AC power source 231 or 250 Hz AC power source 221, respectively, during the on-period (t1) and off-period (t2), respectively, of the input code rate from coding DC power source 241. The defined time break, or, time delay, should also include the maximum turn off times that are exhibited by the outputs of solid-state relays.

By using microprocessor circuit 26 in FIG. 2B or microprocessor IC U2 in FIG. 5B, the need for capacitors and resistors comprising timing networks in FIG. 1 to set various time delays are eliminated since microprocessor circuit 26 is capable of maintaining accurate time delays within the circuit's full operating temperature range.

As part of a newly proposed GRS/Alstom dual frequency cab code railroad signaling system that utilizes multiple frequencies, e.g., both 100 Hz and 250 Hz AC coded currents coupled to the rails of a track 271, a minimum of 5 milliseconds (5 ms) is preferably the required break, or, delay time, between the transmission of the two AC frequencies.

Given the parameters of AC output type solid state relays, whereas ½ cycle of the frequency being switched is the specified maximum turn-off time when a control voltage has been removed from the solid state relay, this turn off time should also be taken into account while maintaining the required minimum 5 millisecond (5 ms) break, or time delay, between the transmission of a second AC current of a different frequency. The mathematical formulas for determining the time delay (Td1, FIG. 6) regulatory values for ensuring the turn off time for the 250 Hz AC currents before the 100 Hz currents can be transmitted are shown below, where T equals time in seconds, and, F equals frequency in Hertz:

T=1/F, where ½ cycle=0.5*T

T=1/250*0.5

T=0.004*0.5

T=0.002 seconds, or 2 ms

Time delay (Td1)=5 ms+(½ cycle of 250 Hz)

Td1=5 ms+(2 ms)

Td1=7 ms, or 0.007 seconds

Similarly, the mathematical formula for determining the time delay (Td2, FIG. 6) regulatory values for ensuring the turn off time for the 100 Hz AC currents before the 250 Hz AC currents can be transmitted are shown below, where T equals time in seconds, and, F equals frequency in Hertz:

T=1/F, where ½ cycle=0.5*T

T=1/100*0.5

T=0.010*0.5

T=0.005 seconds, or 5 ms

Time delay (Td2)=5 ms+(½ cycle of 100 Hz)

Td2=5 ms+(5 ms)

Td2=10 ms, or 0.010 seconds

The operation of the electronic code following relay 53 for the coding of multi frequency AC currents will be described herein below with reference to the timing chart shown in FIG. 6.

Figure 6:
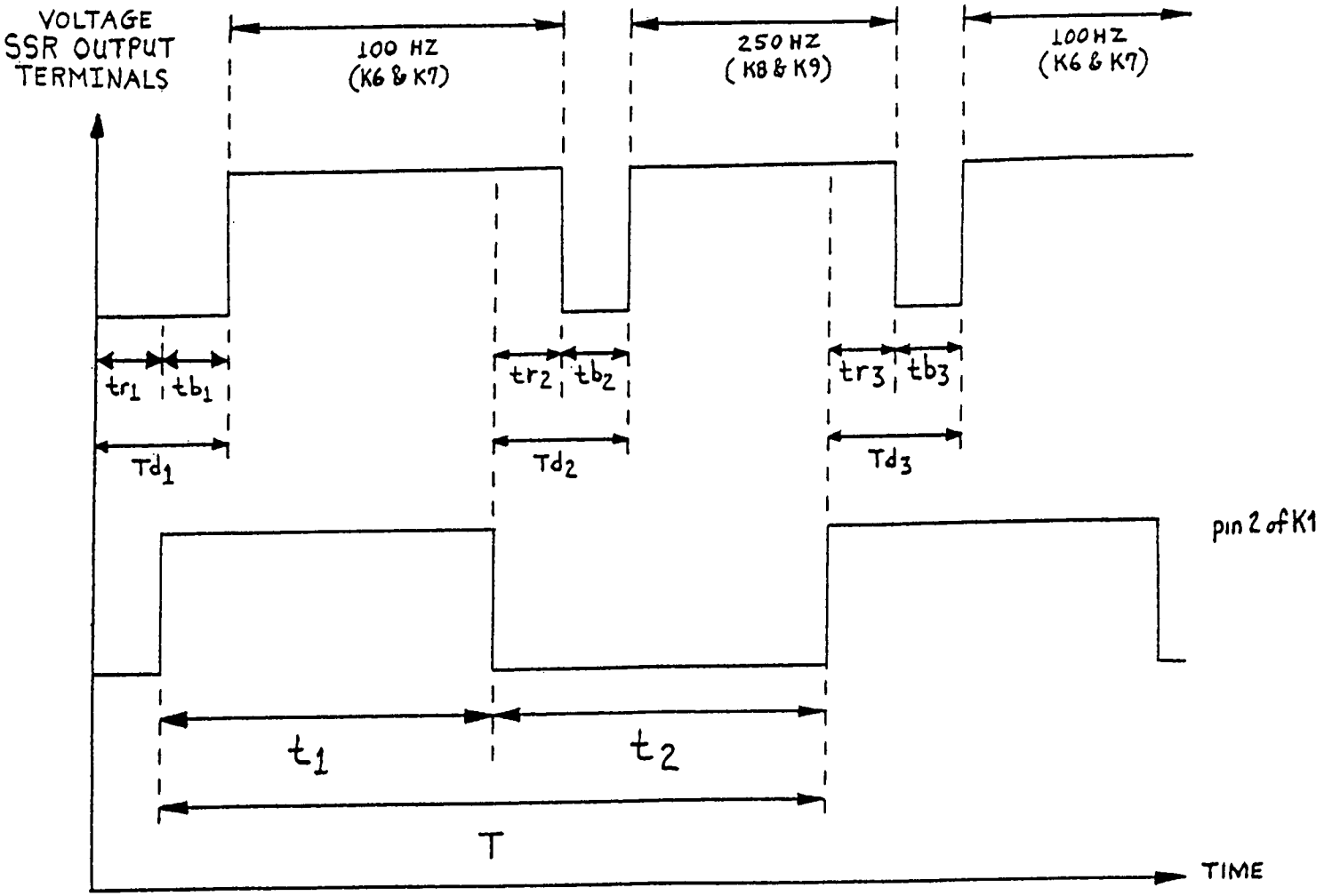
FIG. 6 is a timing chart illustrating the break before make Form C operation of the electronic code following relay in the preferred embodiments of the invention shown in FIG. 5B when coding AC currents.

As shown in the bottom graph of FIG. 6, the coding output DC currents at pin 2 of solid-state relay K1 replicates the received coding DC currents coupled to the controlling pins of relay K1 from coding DC power source 241 as shown in FIG. 5A and FIG. 5B. At the start of on-time period t1, a time delay period Td1 begins for 7 ms (0.007 seconds). When Td1 expires, solid-state relays K6 and K7 conduct AC currents of 100 Hz frequency.

Time delay Td1 is equivalent to the sum of the AC ringing time (tr1) for solid-state relays K8 and K9 when conducting AC currents of 250 Hz frequency, and, a time break (tb1) of 5 ms (0.005 seconds) between the transmission of a $2^{nd}$ AC frequency, as required by a dual AC frequency railroad cab code signaling system. Therefore, Td1=Td3, and, tb1=tb2=tb3. Td1, in seconds, is calculated as follows, where Td1=(tr1)+(tb1) and F=Frequency of the AC currents:

tr1=0.5*(1/F)

tr1=0.5*(1/250 Hz)

tr1=0.5*0.004 seconds tr1=0.002 seconds, or, 2 ms tb1=5 ms, therefore;

Td1=(tr1)+(tb1)

Td1=(2 ms)+(5 ms)

Td1=7 ms, or 0.007 seconds

Though time delay Td1 is intended to meet the maximum solid-state relay turn-off time, or ringing, when conducting AC currents of 250 Hz, as depicted by tr3, time delay period Td1 will occur when output pin 2 of solid-state relay K1 begins output coding currents from 0 volts.

At the termination of on-time period t1, and the start of off-time period t2, solid-state relays K6 and K7 will continue to conduct 100 Hz AC currents, or, ringing, for a maximum time period equivalent to ½ cycle of the 100 Hz frequency. The maximum turn-off time period (tr2) for solid-state relays K6 and K7 is calculated as follows:

tr2=0.5*(1/F)

tr2=0.5*(1/100 Hz)

tr2=0.5*0.01 seconds tr2=0.005 seconds, or, 5 ms

At the start of off-time period t2 for the coding DC current output from pin 2 of solid-state relay K1, time delay Td2 begins for a period of 10 ms (0.010 seconds), whereas, Td2 is the sum of (tr2)+(tb2). As stated above, tr2 is equivalent to 5 ms, and, as previously stated; tb2 is equivalent to 5 ms. Therefore, Td2 is equivalent to 10 ms. At the expiration of Td2, solid-state relays K8 and K9 conduct AC currents at a frequency of 250 Hz.

When off-period t2 of the coding DC currents from pin 2 of relay K1 expires, and, on-time period t1 begins again, time delay Td3 starts, and, delays the conducting of the 100 Hz AC current by solid-state relays K6 and K7, where: Td3=Td1. This cycle of time delayed AC current outputs continues for the duration of the received coding DC current output from pin 2 of solid-state relay K1. The transmitting of coding DC currents from pin 2 of solid-state relay K1 will cease when either of the following conditions exist:

a train is occupying the portion of the signaled track circuit that controls the operation of the code following relay;

or, there is a fault in the portion of the signaled track circuit that controls the operation of the code following relay.

In either of the previously described scenarios, the electronic code following relay of the invention will electronically "de-energize" and conduct output currents from the electronic Normally Closed (N.C.) contacts, which, is the same operational manner of an electro-mechanical code following relay.

Though the timing chart in FIG. 6 depicts AC currents having frequencies of 100 Hz and 250 Hz, and, time delays of 7 milli-seconds (7 ms) and 10 milli-seconds (10 ms), this should not be construed in a limiting sense as one with skill in the art can contemplate that various AC current frequencies and time delays may be used.

By simply varying the programming line codes for microprocessor IC U2 in FIG. 5A or 5B, the electronic code following relay in accordance with the preferred embodiment of the invention can be readily adapted to any AC frequency switching requirements, and/or, provide for various delay times between the transmission of currents for a single AC frequency, or, a combination of different AC frequency currents. Therefore, by regulating the programming line codes for microprocessor IC U2, the electronic code following relay of the present invention is capable of operations in a single AC frequency, or, in a multiple AC frequency cab code railroad signaling system.

Figure 4:
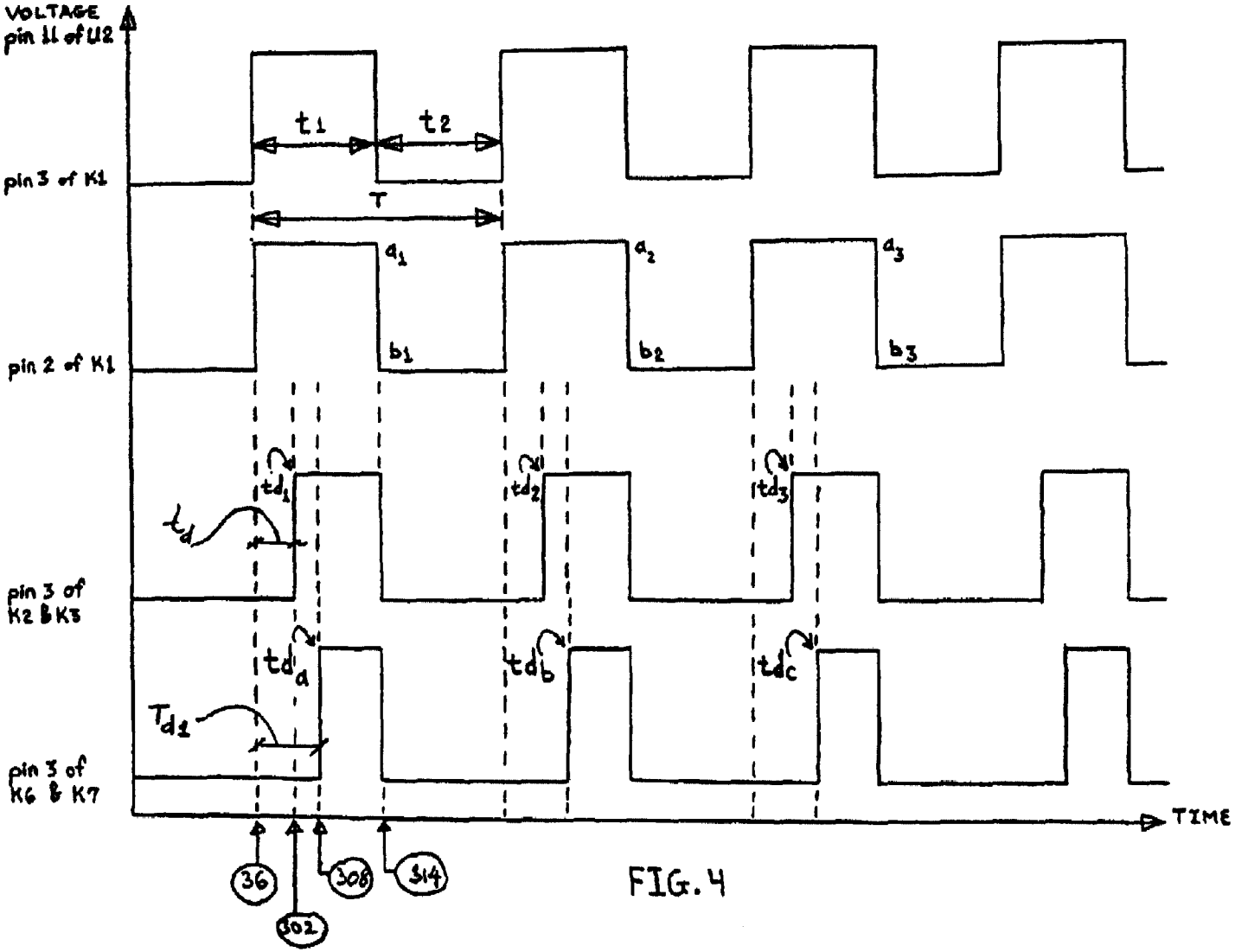
FIGS. 4 and 4A are timing charts illustrating the operation of the electronic code following relay in the preferred embodiments of the invention.

For example, the time period while pin 11 of opto-coupler IC U3 is in a HIGH output state is also the on-time period t1 in FIG. 4, and is determined by, among other things, process 304 and process 306 in FIG. 3A. The time period while pin 11 of opto-coupler IC U3 is in a LOW output state is also the off-period time t2 in FIG. 4, and is determined by, among other things, processes 310, 312, and 314 in FIGS. 3A and 3B.

Figure 4A:
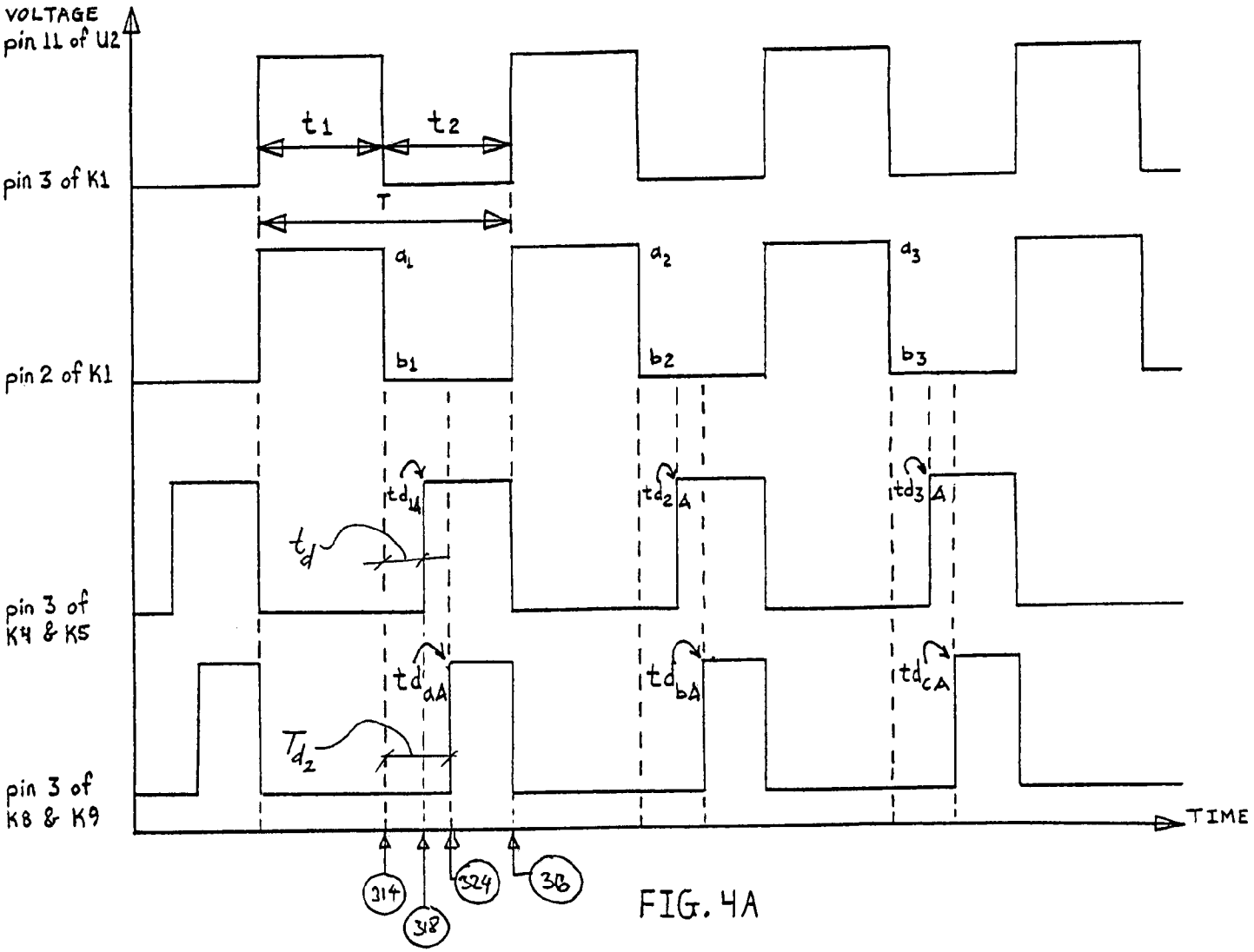

Similarly, the time period while pin 15 of opto-coupler IC U3 is in a HIGH output state is also the off-time period t2 in FIG. 4A, and is determined by, among other things, process 320 and process 322 in FIG. 3B. The time period while pin 15 of opto-coupler IC U3 is in a LOW output state is also the on-period time t1 in FIG. 4A, and is determined by, among other things, processes 326, 328, and 36 in FIG. 3B.

However, for a 1st output pin 9 of opto-coupler IC U3 during on-time period t1, the time delay regulatory process 300 and process 302 in FIG. 3 are governed only by the solid-state relay's manufactured operating characteristics when conducting DC currents from the same DC power source 20, and, having a much faster turn off speed than AC output type solid-state relays.

Similarly, for a 3rd output pin 13 of opto-coupler IC U3 during off-time period t2, the time delay regulatory process 316 and process 318 in FIG. 3 are governed only by the solid-state relay's manufactured operating characteristics when conducting DC currents from the same DC power source 20, and, having a much faster turn off speed than AC output type solid-state relays.

In a preferred embodiment, the DC output solid-state relays K2 and K3 (and/or K4 and K5) typically have a maximum turn off time of 300 microseconds (300 μs) after a controlling voltage has been removed. Therefore, a time delay period should be selected that is of a sufficient period ensuring the conducting currents of the aforementioned solid-state relays have ceased. An approximate time delay of 360 microseconds (μs) is of a sufficient time delay to maintain a break before make/Form C type relay operations for the coded DC output currents in accordance with the preferred embodiment of the invention. This time delay period is denoted as td in FIGS. 4 and 4A.

As stated previously, the sequence of square wave DC currents generated by opto-coupler IC U3 at output pins 9, 11, 13 and 15 are coupled to the control pins of various type solid-state relays. In some cases, the control sections of solid-state relays can present themselves as an invisible load, or, no load, condition to a driving circuit due to the high impedance exhibited by the internal opto-electronic components that comprises the controlling section of solid-state relay(s). A high impedance load presenting itself as a "no load" condition to a driving circuit, such as, but not limited to, opto-coupler IC U3, can distort the coded output square wave drive voltages considerably and fail to properly drive the solid-state relay load(s). Such a condition would cause train delays.

A modified embodiment of the present invention is introduced to solve this problem. FIG. 5B further shows load resistor network RN3 utilizing a number, e.g., 4, of internal resistors having appropriate resistance values with first ends coupled to output pins 9, 11, 13, and 15 of opto-coupler IC U3, and second ends of resistor network RN3 coupled to a negative output of DC-DC converter U1 which effectively couples load resistor network RN3 in parallel with the controls of the solid-state relay loads. Therefore, inclusion of load resistor network RN3 ensures the coded square wave driving voltages from pins 9, 11, 13, and 15 of opto-coupler IC U3, will be of proper waveform and duty cycle when coupled to the solid-state relay loads. Resistor network RN3 also ensures zero drive voltages to the controls of solid-state relays K2, K3, K4, K5, K6, K7, K8, and K9 when no output driving currents are to be conducted by the aforementioned solid-state relays.

It should be noted that not all-solid state relays present themselves as an "invisible load", or, no load condition to driving circuits, such as, but not limited to, opto-coupler IC U3. Therefore, the inclusion of load resistor(s), such as RN3, across the output(s) of opto-coupler IC U3 may not be necessary. In addition, the number of resistors in RN3 may vary depending on the number of output pins of opto-coupler IC U3 and/or SSR relays (K2-K9).

Under actual working conditions, the electronic code following relay in accordance with the preferred embodiments of the present invention should function in the same capacity as a Form C, Single Pole Double Throw (SPDT)

electro-mechanical relay, having contacts that break before make. Therefore, additional sets of contacts should be made available that will output coded DC currents, coded AC currents, a combination of both coded DC and coded AC currents, or combination of both coded DC and multiple frequency coded AC currents during the on-period (t1) and/or the off-period (t2) of the input code from coding DC power source 241 in FIG. 2B, and 5B.

The operation of the embodiment disclosed in FIGS. 2A and 5A is similar to the operation of the NO contacts of the embodiment disclosed in FIGS. 2B and 5B and described with respect to FIGS. 3A and 4 and, therefore, will not be repeated herein.

However, in FIG. 5A, microprocessor IC U2 employs serial connections of voltage drop resistors R4 and R5 to limit the amount of controlling currents to opto-coupler IC U3 during the prescribed on-state time t1 of the input of coding DC currents from trigger relay K1. However, it has been found by the inventors that a serial connection of a voltage drop resistor is not ideal for operating the controls of opto-coupler IC U3 when coupled to outputs from microprocessor IC U2. Though opto-coupler IC U3 can be operated with a voltage drop resistor having a serial connection to microprocessor IC U2, the output driving voltage is reduced to levels below the stated minimum operating values for the controls of opto-coupler IC U3. Ideally, during the absence of a driving voltage from microprocessor IC U2, the controls of opto-coupler IC U3 should be at, or near, 0 volts. However, it has been found a serial connection of a voltage drop resistor causes an output driving voltage from microprocessor IC U2 of approximately 280 millivolts (280 mV) during the prescribed off-state time t2 of the input of coding DC currents from trigger relay K1.

To solve the above problems, one or both resistors networks RN1 and RN2 (FIG. 5B) may be used in an electronic code follower relay in accordance with the present invention. Resistor network RN1 preferably employs four (4) independent resistors each having a first end coupled to output pins 12, 13, 14, and 15 of microprocessor IC U2 respectively. The second ends of the independent resistors of resistor network RN1 are internally bused together and are coupled to a positive output of DC-DC converter U1.

Essentially, resistor network RN1 operates as pull up resistors for the outputs of microprocessor IC U2. By choosing the appropriate resistance values for resistor network RN1, the output driving voltages from microprocessor IC U2 are pulled up to the fullest potential of the output currents from DC-DC converter U1. Therefore, during the absence of coding input DC currents to pin 11 of microprocessor IC U2 from trigger relay K1, the output driving currents from microprocessor IC U2 turns off the controlling circuits of opto-coupler IC U3 for the Normally Open (N.O.) solid-state relay outputs. During the presence of input DC currents to pin 11 of microprocessor IC U2 from trigger relay K1, the output driving currents from microprocessor IC U2 turns off the controlling circuits of opto-coupler IC U3 for the Normally Closed (N.C.) solid-state relay outputs.

Resistor network RN2 preferably employs four (4) other independent resistors with each having a first end coupled to controlling pins 1, 3, 5, and 7 of opto-coupler IC U3 respectively. The second ends of the independent resistors comprising resistor network RN2 are internally bused together and are coupled to a positive output of DC-DC converter U1.

Essentially, resistor network RN2 operates as voltage drop resistors for the input controlling circuits of opto-coupler IC U3. By choosing the appropriate resistance values for resistor network RN2, the controlling drive voltages for opto-coupler IC U3 can be set within its proper operating voltage range. Preferably, the output driving voltages are set at the mid-point of the stated minimum and maximum operating voltage range for the controlling circuits of opto-coupler IC U3.

Essentially, the circuit placement of resistor networks RN1 and RN2 operates the controlling circuits of opto-coupler IC U3 in an inverse mode of the output drive currents received from microprocessor IC U2. Whereas, opto-coupler IC U3 outputs driving voltages to the controls of solid-state relays K2, K3, K4, K5, K6, K7, K8, and K9 when sink (grounded) drive voltages are received from microprocessor IC U2 during the LOW state. When the output drive currents from microprocessor IC U2 are in a HIGH state, opto-coupler IC U3 shuts off the output driving currents coupled to the controls of the aforementioned solid-state relays thereby placing the solid-state relays into an open state. Should microprocessor IC U2 LOW or HIGH output drive voltages coupled to opto-coupler IC U3 become an open, the aforementioned solid-state relays will not conduct output currents. Thus, an arrangement of resistor networks RN1, RN2, and opto-coupler U3 ensures no output driving voltages will be present on the controls of the SSR driving circuits K2, K3, K4, K5, K6, K7, K8 and K9 during startup 30 (FIG. 3A).

The embodiment disclosed in FIG. 5B may further include indicator circuit 540 which is comprised of resistor R9 and LED D5. LED D5 has a cathode coupled to a negative output from DC-DC converter U1 and an anode coupled to one end of voltage drop resistor R9. A second end of voltage drop resistor R9 is connected pin 13 of opto-coupler circuit IC U3. Generally, indicator circuit 540 is constructed and functions similarly to indicator circuit 58 of FIG. 5A.

The electronic code following relay in accordance with the preferred embodiments of the present invention, has many advantages.

The inventive design can outperform comparable devices presently in service in a railroad signaling system, and other devices available on the market. The electronic code following relay of the invention acts as a direct replacement device for 67% of the electro-mechanical relays presently used in a GRS/Alstom AC Phase Selective railroad signaling system.

In another 33% of the aforementioned applications, whereas only AC currents are coded by a code following type relay, only one additional wire would be needed to a spare contact in the relay base to couple a V+ source to the internal electronic circuitry of the invention. This additional wire would not have to be removed in instances when an electro-mechanical code following relay is substituted in place of the electronic code follower relay in accordance with the preferred embodiments of the invention.

Two or more visual LED indicators are provided to aid railroad personnel in determining the contacts output status of the electronic code follower relay in accordance with the preferred embodiments of the invention, whereas, the present electro-mechanical code following type relay is usually housed in a transparent cover allowing for easy visual inspections of the relay's contact positions.

Furthermore, railroad personnel are accustomed to how an electro-mechanical code following relay "sounds" while the relay is in a coding state, therefore, visual indicators are needed with electronic type code following relays.

Still yet a further advantage of the electronic code follower relay in accordance with the preferred embodiments of the invention is to reduce repair and replacement costs that are associated with electro-mechanical relays used as code following relays. Electro-mechanical relays are prone to contact arcing while coding currents.

In some cases, electro-mechanical relays have been known to fail due to burnt contacts, or other factors, in as short a period of three (3) months in-service time. The solid state design in accordance with the preferred embodiments of the invention eliminates this problem, as well as others, by having no moving contacts that can draw arcs during the coding process of DC currents, or, AC currents.

Still yet a further advantage of the electronic code follower relay in accordance with the preferred embodiments of the invention is the output accuracy when electronically replicating the code rates and duty cycles of the applied controlling code rates from a railroad signaling system, whereas electro-mechanical code following relays are prone to inaccuracies due to many mechanical operational factors.

Yet another advantage of the electronic code follower relay in accordance with the preferred embodiments of the invention is to provide time delay regulatory circuitry that can be easily modified to allow the invention to function with a multitude of AC current frequencies, as well as, to provide for any time break between the output of the various AC current frequencies in accordance with the requirements of a dual AC frequency cab code railroad signaling system.

Still another advantage of the electronic code follower relay in accordance with the preferred embodiments of the present invention allows for the use in a single AC frequency cab code railroad signaling system, with the remaining AC output switches available for a future use. For example, when a present single frequency cab code railroad signaling system is to be upgraded to a dual AC frequency cab code railroad signaling system at some future date in time.

Yet a further advantage of the electronic code follower relay in accordance with the preferred embodiments of the present invention is an electronic code following relay that acts in the same manner as an electro-mechanical Form C relay having Single Pole Double Throw (SPDT) contact sets, and features the same break before make contact principles by incorporating delay times between the conducting states for the electronically simulated Normally Closed (N.C.) contacts, or, switches, and the electronically simulated Normally Open (N.O.) contacts, or, switches.

In particular, DC coded currents are received from a DC coding power source from a railroad signaling system and are applied to time delaying circuits comprised preferably by microprocessor IC U2 and opto-coupler IC U3 via a V+ delivery from relay K1 during the on-time (t1) of the coding DC currents to microprocessor IC U2, microprocessor IC U2 will wait a predetermined time period, e.g., 7 milliseconds (ms), as denoted at Td1 in FIG. 4, before allowing the operation of a controlling circuit of opto-coupler IC U3, after which opto-coupler IC U3 then conducts driving currents to the controls of the AC driving circuits comprised of solid-state relays K6 and K7 to conduct AC currents of, a first frequency, e.g., 100 Hz, and, will continue to conduct said 100 Hz AC currents for the remaining time duration of on-time period (t1) of the input DC coded currents from a railroad signaling system, and DC output solid-state relays K2 and K3 will also be triggered to conduct coded DC currents to various components of a railroad signaling system, but, at a time delayed response, denoted as td in FIG. 4, of approximately 360 microseconds (μs).

At the termination of the on-time period (t1), off-time period (t2) begins, thus turning off the controls of opto-coupler IC U3 and the output currents of solid-state relays K2, K3, K6, and K7 coupled to the outputs of opto-coupler IC U3, and starts additional time delaying circuits of microprocessor IC U2, whereas another or the same time delaying circuit of microprocessor IC U2 will wait a predetermined time period, e.g., 10 milliseconds (ms), as denoted at Td2 in FIG. 4A, before allowing the operation of a controlling circuit of opto-coupler IC U3, after which opto-coupler IC U3 then conducts driving currents to the controls of the AC driving circuits comprised of K8 and K9 to conduct AC currents of, a second frequency, e.g., 250 Hz, and, will continue to conduct 250 Hz AC currents for the remaining time duration of off-time period (t2) of the input DC coding currents from a railroad signaling system, and DC output solid-state relays K4 and K5 will also be triggered to conduct coded DC currents to various components of a railroad signaling system, but, at a time delayed response, denoted as td in FIG. 4A, of approximately 360 microseconds (μs).

As the input DC coding currents continue to arrive to the controlling circuit of solid-state relay K1, at the termination of the off-time period (t2), on-time period (t1) begins again, thus turning off the driving voltages coupled from opto-coupler circuit IC U3 to the controls of solid-state relays K4, K5, K8, and K9, and a V+ delivery from K1 to microprocessor circuit IC U2 is applied once again to repeat the above process until a train occupies a portion of the railroad signaling system and terminates the DC coding currents from a railroad signaling system. When a train no longer occupies a portion of the railroad signaling system, the coding DC currents from the railroad signaling system will resume, and the entire process repeats for the on-time period (t1) and the off-time period (t2). The above arrangement is for exemplary purposes only, and should not be construed in a limiting sense.

The electronic code follower relay in accordance with the preferred embodiments of the present invention is preferably recommended for use with a coding DC power source (e.g., 241 in FIG. 2B) having nominal output voltages of 12 VDC. However, in a GRS/Alstom AC Phase Selective cab code railroad signaling system, there exist other coding DC sources having other nominal output voltages of, e.g., 1.7. The electronic code follower relay in accordance with the preferred embodiments of the present invention can be modified for use with such a power source.

For example, the electronic code following relay 53 depicted in FIG. 5B may further comprise voltage drop resistor R1 having a serial connection to diode D2 coupled in series with positive control pin 3 of solid-state relay K1, and, a positive terminal of a coding DC power source 241. A simple circuit arrangement whereas voltage drop resistor R1 and diode D2 are substituted with jumper wires to create zero Ohm resistance paths, or shorts, and solid-state relay K1 is of a type having an operating DC control voltage of 1.7, the code following relay of the invention would serve as a suitable electronic replacement for code following electro-mechanical relays that operate from coding DC power sources having 1.7 nominal outputs. One of skill in the art can contemplate other circuit arrangements for solid-state relays K2, K3, K4, K5, K6, K7, K8, and K9 can be made to satisfy other circuit requirements in various railroad signaling systems.

In another embodiment of the invention, electronic code following relay 53 depicted in FIG. 5B may further include a resistor (not shown) having a first end coupled to a control pin 3 of solid-state relay K1 and a second end coupled to a pin 4 of solid-state relay K1, and having an appropriate resistance value to maintain the same load impedance that is presented by an electro-mechanical code following relay to a coding DC power source.

A significant advantage of the electronic code follower relay in accordance with the preferred embodiments of the present invention is that it is of a universal design and is capable of functioning in any capacity that presently utilizes electro-mechanical code following relays in a railroad signaling system.

Another significant advantage of the electronic code follower relay in accordance with the preferred embodiments of the present invention is fail safety. The likely failure scenarios for solid-state relays are shorted or opened internal switches. For each of the aforementioned failure modes, vital electro-mechanical relays in the railroad signaling system would de-energize, thus triggering the fail safe design principles of a railroad signaling system, and, or, the coding output AC currents would either become distorted, or, non-existent causing a received signal rejection by a train's on-board cab code detection system, or, by the various code detection components of a cab code railroad signaling system.

For failures in the time delay regulatory circuits, whereas should the time delays become too narrow, or shortened, the over current protection devices (i.e. fuses or circuit breakers) in a railroad signaling system would interrupt AC output currents from an AC power source, or, sources, to the electronic code follower relay in accordance with the preferred embodiments of the present invention, thereby triggering the above mentioned fail safe design principles of a railroad signaling system, and/or, that of the fail safe design principals of a train's on-board cab code detection system.

For failures in the time delay regulatory circuits, whereas should the time delays become too long, or, extended, vital electro-mechanical relays in the railroad signaling system would de-energize, thus triggering the fail safe design principles of a railroad signaling system, and/or, the output AC currents would either become distorted, or, non-existent causing a rejection of the received coded currents by the train's on-board cab code detection system, and/or, by code detection components of a cab code railroad signaling system.

Advantageously, the preferred embodiments of the present invention provide an electronic code following relay (i) that has output currents precisely replicating the code rate and duty cycle of the applied coded DC currents to its controls under harsh environmental conditions, (ii) that cannot produce any ambiguous output states upon the installation, or removal, to/from a railroad's signaling system, (iii) that is capable of retaining its internal programming for up to 15 years, or longer, during the absence of input DC power without the need of a redundant power source, (iv) that can be a direct, or near direct, replacement for existing electro-mechanical code following relays which either become obsolete, or, are found to be defective, (v) that allows for variable output time delays providing for a break before make (Form C) operational feature, (vi) that provides electronically controlled sets of Normally Open (N.O.) and Normally Closed (N.C.) contacts, or, switches, which function in the same manner and capacity as those of a typical Form C Single Pole-Double Throw (SPDT) electro-mechanical relay, (vii) that of universal design with visual indicators to indicate the Normally Closed (N.C.) and Normally Open (N.O.) relay contact positions, (viii) that uses a dedicated DC power source to provide input power to a microprocessor circuit, (ix) that uses a dedicated DC power source transmitted as a coding DC power source to a microprocessor circuit, (x) that can be replaced with an electro-mechanical relay without requiring wiring revisions be made to an existing railroad signaling system, and (xi) that also functions as a standard operating non-coding type relay.

It will be obvious to those having ordinary skill in the art upon reading the foregoing specification that many changes may be made in the above-described embodiments of the present invention without departing from the underlying principles thereof. Accordingly, it is intended that the protection granted hereon be limited only by the definition contained in the appended claims and equivalents thereof.

What is claimed is:

1. An electronic code following relay, comprising:

a timing circuit for receiving an input square wave signal coded at a pre-determined code rate, and regenerating the input square wave signal at said pre-determined code rate after a predetermined time delay; and a driving circuit coupled to said timing circuit for receiving the delayed square wave signal therefrom and conducting, at the predetermined code rate, at least a power source to at least one of various components in a railroad signaling system and a rail of a track.

2. The electronic code following relay of claim 1, further comprising a dedicated power source, coupled to at least said timing circuit for providing an isolated DC power source to the timing circuit.

3. The electronic code following relay of claim 1, further comprising a solid-state relay coupled to an input of said timing circuit to replicate the input square wave signal received from a coding power source and output the replicated input square wave signal to said timing circuit, thereby isolating the timing circuit from undesired signals coming from the coding power source.

4. The electronic code following relay of claim 1, wherein said driving circuit comprises a plurality of solid-state relays coupled to said timing circuit for receiving the delayed square wave signal therefrom and for conducting, at the predetermined code rate, at least two different power sources to the various components in the railroad signaling system and the railroad tracks.

5. The electronic code following relay of claim 1, wherein said timing circuit is a microprocessor circuit.

6. The electronic code following relay of claim 5, wherein said driving circuit comprises an opto-coupler coupled to and driven by said microprocessor circuit; and a plurality of solid-state relays coupled to and driven by said opto-coupler for conducting, at the predetermined code rate, various power sources to the various components in the railroad signaling system.

7. The electronic code following relay of claim 6, wherein said time delay of said microprocessor circuit is programmably adjustable.

8. The electronic code following relay of claim 6, wherein said microprocessor circuit has multiple time delays with which the input square wave signal is regenerated for different sets of said solid-state relays which, as a result, function as Normally Closed (N.C.) and Normally Open (N.O.) contacts during an off-time period and an on-time period, respectively, of said input square wave signal.

9. The electronic code following relay of claim 6, further comprising a solid-state trigger relay coupled to said microprocessor circuit for receiving and replicating the input square wave signal from a coding power source of the railroad signaling system and outputting the replicated input square wave signal to said microprocessor circuit, thereby isolating the microprocessor circuit from undesired signals coming from the coding power source; and a dedicated power source, coupled to said microprocessor circuit and said opto-coupler for providing an isolated DC power source to said microprocessor circuit and opto-coupler.

10. An electronic code following relay for conducting at least one of coded DC and AC currents to various components in a railroad signaling system, the electronic code following relay comprising:

a controlling relay having an input connectable to a coding power source of the railroad signaling system to receive therefrom a square wave signal coded at a predetermined code rate and duty cycle, replicate the input square wave signal and output the replicated input square wave signal;

a microprocessor integrated circuit coupled to an output of said controlling relay for receiving the replicated square wave signal, said microprocessor integrated circuit comprising at least first and second microprocessor-programmed time delay regulator circuits for delaying the square wave signal with at least first and second different predetermined time delays, respectively;

an opto-coupler integrated circuit having at least first and second control inputs coupled to said first and second time delay regulator circuits, respectively, of said microprocessor integrated circuit, and at least first and second independently operated outputs controlled by said first and second time delay regulator circuits via said first and second control inputs, respectively, of said opto-coupler integrated circuit;

at least a first solid-state relay coupled to the first output of said opto-coupler integrated circuit, for receiving the square wave signal delayed with the first time delay and conducting, at the predetermined code rate, at least a first power source to certain components in the railroad signaling system;

at least a second solid-state relay coupled to the second output of said opto-coupler integrated circuit, for receiving the square wave signal delayed with the second time delay and conducting, at the predetermined code rate, at least a second, different power source to certain components in the railroad signaling system; and a dedicated DC power source coupled to at least said microprocessor integrated circuit for providing an isolated DC power source to the microprocessor integrated circuit.

11. The electronic code following relay of claim 10, wherein said first and second power sources are a DC power source and an AC power source, respectively, and the first time delay is smaller than the second time delay.

12. The electronic code following relay of claim 10, being configured as a Form C, break before make, Single Pole Double Throw (SPDT) type relay said first and second solid-state relays together defining Normally Closed (N.C.) contacts of said SPDT type relay which conduct the respective power sources to the respective components in the railroad signaling system during an off-time period of the square wave signal.

13. The electronic code following relay of claim 12, further comprising third and fourth solid-state relays together defining Normally Open (N.O.) contacts of said SPDT type relay which conduct respective power sources to respective components in the railroad signaling system during an on-time period of the square wave signal;

said microprocessor integrated circuit further comprising third and fourth microprocessor-programmed time delay regulator circuits for delaying the square wave signal with third and fourth predetermined time delays, respectively; and said opto-coupler integrated circuit further comprising third and fourth control inputs coupled to said third and fourth time delay regulator circuits, respectively, of said microprocessor integrated circuit, and third and fourth independently operated outputs controlled by said third and fourth time delay regulator circuits, respectively, and coupled to said third and fourth solid-state relays.

14. The electronic code following relay of claim 13, further comprising two of each of said first, second, third, and fourth solid-state relays.

15. The electronic code following relay of claim 13, further comprising load resistors coupled in parallel with the outputs of the opto-coupler integrated circuit to maintain square wave output pulses to the solid-state relays coupled to said outputs of said opto-coupler integrated circuit.

16. The electronic code following relay of claim 11, further comprising a MOV surge suppressor coupled in parallel with AC terminals of the second solid state relay which conducts the AC power source to the components of the railroad signaling system.

17. The electronic code following relay of claim 16, further comprising current in-rush limiters coupled in series with at least one of the AC terminal of said second solid-state relay.

18. The electronic code following relay of claim 15, further comprising pull up resistors coupled to the outputs of said microprocessor integrated circuit to maintain a predetermined voltage when the solid-state relays are not conducting.

19. In combination, an electronic coding power source for generating, at a predetermined code rate, a square wave signal with a predetermined duty cycle; and an electronic code following relay comprising a timing circuit for receiving the square wave signal as an input thereof and delaying the input square wave signal at an output thereof with a predetermined time delay; and a driving circuit coupled to said timing circuit for receiving the delayed square wave signal therefrom and conducting, at the predetermined code rate, at least a power source to various component of a railroad signaling system.

20. The combination of claim 19, wherein said electronic code following relay is configured as a Form C, break before make, Single Pole Double Throw (SPDT) type relay and comprises:

a controlling relay having an input coupled to said coding power source to receive therefrom the input square wave signal, replicate the input square wave signal and output the replicated input square wave signal;

said timing circuit being a microprocessor integrated circuit coupled to an output of said controlling relay for receiving the replicated square wave signal, said microprocessor integrated circuit comprising four microprocessor-programmed time delay regulator circuits for delaying the square wave signal with different predetermined time delays;

said driving circuit comprising:

an opto-coupler integrated circuit having four control inputs coupled respectively to said four microprocessor programmed time delay regulator circuits, and four independently operated Darlington type outputs;

four solid-state relays forming the Normally Open (N.O.) contacts in said SPDT type relay and being coupled to two of said outputs of said opto-coupler integrated circuit for receiving the delayed square wave signal and conducting, at the predetermined code rate, at least a DC power source and an AC power source of a first frequency to the components in the railroad signaling system during an on-time period of the square wave signal;

four solid-state relays forming the Normally Closed (N.C.) contacts in said SPDT type relay and being coupled to the other two outputs of said opto-coupler integrated circuit, for receiving the delayed square wave signal and conducting, at the predetermined code rate, the DC power source and another AC power source of a second, different frequency to the components in the railroad signaling system during an off-time period of the square wave signal; and a dedicated DC power source, coupled to at least said microprocessor integrated circuit for providing an isolated DC power source to the microprocessor integrated circuit.

* * * * *